US008011478B2

(12) United States Patent
Utsunomiya

(10) Patent No.: US 8,011,478 B2
(45) Date of Patent: Sep. 6, 2011

(54) ELEVATOR VIBRATION DAMPING SYSTEM HAVING DAMPING CONTROL

(75) Inventor: Kenji Utsunomiya, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 13/028,720

(22) Filed: Feb. 16, 2011

(65) Prior Publication Data

US 2011/0132697 A1 Jun. 9, 2011

Related U.S. Application Data

(62) Division of application No. 11/917,350, filed as application No. PCT/JP2005/011251 on Jun. 20, 2005, now Pat. No. 7,909,141.

(51) Int. Cl.
*B66B 1/34* (2006.01)

(52) U.S. Cl. ..... 187/292; 187/391

(58) Field of Classification Search ..... 187/247, 187/277, 278, 292, 391, 393, 409
See application file for complete search history.

(56) References Cited

U.S. PATENT DOCUMENTS

| | | | | |
|---|---|---|---|---|
| 5,086,882 | A | 2/1992 | Sugahara et al. | |
| 5,289,902 | A | 3/1994 | Fujita | |
| 5,400,872 | A | 3/1995 | Skaiski et al. | |
| 5,866,861 | A * | 2/1999 | Rajamani et al. | 187/292 |
| 6,474,449 | B1 | 11/2002 | Utsunomiya et al. | |
| 6,494,295 | B2 | 12/2002 | Grundman | |
| 7,007,774 | B2 | 3/2006 | Utsunomiya et al. | |
| 7,314,119 | B2 | 1/2008 | Husmann et al. | |
| 7,401,683 | B2 | 7/2008 | Husmann et al. | |
| 7,424,934 | B2 | 9/2008 | Husmann et al. | |
| 7,793,763 | B2 | 9/2010 | Zhu et al. | |
| 7,909,141 | B2 * | 3/2011 | Utsunomiya | 187/292 |
| 2004/0020725 | A1 | 2/2004 | Utsunomiya et al. | |

FOREIGN PATENT DOCUMENTS

| | | |
|---|---|---|
| JP | 03-088687 | 4/1991 |
| JP | 05-116869 | 5/1993 |
| JP | 05-246661 | 9/1993 |

(Continued)

OTHER PUBLICATIONS

Pan, Gongyu et al., "Magnetorheological Damper and Its Application on the Semi-active Vibration Control", The Japan Society of Mechanical Engineers Proceedings of Dynamics and Design Conference, 2000 (with English abstract).

*Primary Examiner* — Jonathan Salata
(74) *Attorney, Agent, or Firm* — Oblon, Spivak, McClelland, Maier & Neustadt, L.L.P.

(57) ABSTRACT

A vibration damping system for an elevator is provided with a damping device (5) that is provided between a cab (1) and a car frame (2) for supporting the cab (1) and whose damping coefficient can be changed. A speed detector detects the traveling speed of a reference elevator car, and a calculation unit (15) receiving the traveling speed detected by the speed detector calculates a control signal for the damping device (5), and outputs the control signal to the damping device. The calculation unit (15) controls the damping device (5) in such a way that, in the case where the traveling speed exceeds a predetermined value, the damping coefficient of the damping device (5) is larger than that in the case where the traveling speed is the same as or smaller than the predetermined value.

6 Claims, 15 Drawing Sheets

FOREIGN PATENT DOCUMENTS

| | | |
|---|---|---|
| JP | 07-187549 | 7/1995 |
| JP | 9-240930 | 9/1997 |
| JP | 2001-122555 | 5/2001 |
| JP | 2002-003090 | 1/2002 |
| JP | 2002-173284 | 6/2002 |
| JP | 2004-035163 | 2/2004 |

* cited by examiner

ELEVATOR VIBRATION DAMPING SYSTEM HAVING DAMPING CONTROL

CROSS-REFERENCE TO RELATED APPLICATIONS

This application is a divisional application of and claims the benefit of priority from U.S. application Ser. No. 11/917,350 filed Dec. 13, 2007, the entire contents of which is incorporated by reference. U.S. application Ser. No. 11/917,350 is a national stage of International application PCT/JP05/11251, filed Jun. 20, 2005.

TECHNICAL FIELD

The present invention relates to an elevator that travels within a hoistway in an architectural structure and more particularly to a vibration-damping/controlling technology, for an elevator, which reduces a transverse vibration of the elevator traveling at high speed.

BACKGROUND ART

Construction of high-rise buildings has been raising the need for high-speed elevators. In realizing the further speedup of an elevator, the importance of an elevator-car-vibration reduction technology has been ever increasing.

As a technology for reducing a transverse elevator-car vibration, a method exists in which a sensor for detecting a transverse car vibration and an actuator for applying vibration-damping force to the car are provided, and force, having a direction opposite to that of the transverse vibration, is applied through the actuator to the car so as to reduce the vibration (e.g., refer to Patent Document 1).

In particular, the control, in which the actuator generates force whose direction is opposite to that of a transverse car vibration and whose magnitude is in proportion to the speed of the transverse car vibration, is referred to as "skyhook damping control". In addition, the skyhook damping control demonstrates the same effects as those demonstrated when a damping device (vibration damping device) fixed between a car and the space works; that is why it is referred to as "skyhook damping control".

Additionally, a method also exists in which, instead of generating vibration-damping force by use of an actuator, by controlling physical parameters, of an elevator car, related to damping or rigidity, a vibration is reduced (for example, refer to Patent Document 2).

Karnopp et al. has proposed a method in which, by changing the damping coefficient of a damping device, control similar to the skyhook damper control is realized (for example, refer to Non-Patent Document 1).

When a car passes an adjacent car or a counterweight, a large wind pressure is caused, whereby the car is vibrated; thus, a method also exists in which, the speed of the car or its opponent is reduced when the car and the opponent pass each other, in order to reduce the vibration upon the mutual passing (for example, refer to Patent Document 3).

Patent Document 1

Japanese Patent Application Laid-Open No. 2001-122555

Patent Document 2

Japanese Patent Application Laid-Open No. H09-240930

Patent Document 3

Japanese Patent Application Laid-Open No. 2002-3090

Non-Patent Document 1

"Semi-active Vibration Control Utilizing MR Damper" by Gongyu Pan, Hiroshi Matsuhisa, and Yoshihisa Honda, Collected Lecture Papers of the "Dynamics and Design Conference (2000), published by the Japan Society of Mechanical Engineers, September 2000.

DISCLOSURE OF THE INVENTION

Problem to be Solved by the Invention

The vibration damping method utilizing an actuator demonstrates a large vibration damping effect, in the case where a vibration is small. However, the force that can be generated by an actuator has an upper limit; thus, such a large vibration as requires force that exceeds the upper limit cannot sufficiently be suppressed. Even in the case where the required force does not exceed the upper limit, much energy is dissipated, when the vibration is large.

The method in which physical parameters, of an elevator car, related to damping or rigidity are controlled may require small energy; however, its performance is lower than that of the control by use of an actuator. In the case of the method according to Non-Patent Document 1, a damping device provided between a car and a guide rail is intended for generating damping force proportional to the speed of a transverse car vibration. However, the damping device generates damping force in a direction opposite to that of the speed of change in the distance between the car and the guide rail; therefore, the damping force, which is desired to be generated, proportional to the speed of the transverse car vibration can be generated only when the respective directions of the speed of change in the distance between the car and the guide rail and the speed of the transverse car vibration are the same. The control is performed in such a way that, in the case where the foregoing directions are opposite to each other, the damping force generated by the damping device becomes zero. At the timing when the damping force is rendered zero or at the timing when the damping force is changed from zero to a predetermined value, impact force is generated; therefore, it has been an issue that, with the method according to Non-Patent Document 1, displacement can be reduced, but acceleration cannot sufficiently be reduced.

In the case of the method in which, in order to reduce a transverse vibration due to a wind pressure caused by an elevator car passing another elevator car or a counterweight, the speed of the elevator car is decelerated, it has been an issue that it is made difficult to further enhance the speed of an elevator. Here, a wind pressure that is caused, e.g., by an elevator car passing another elevator car or a counterweight is also referred to as a "wind disturbance".

An elevator car is configured with a car frame pulled with a rope, a cab, which is fixed to the car frame by the intermediary of vibration-proofing materials and accommodates passengers, and the like. The inherent vibration modes of a transverse elevator-car vibration include a first mode in which the antinode (the region or point of maximum amplitude) of the vibration falls within the space between the guide rail and the car frame and a second mode in which the antinode of the vibration falls within the space between the car frame and the cab. The frequency of the second-mode inherent vibration is higher than that of the first-mode inherent vibration.

The main cause of a transverse elevator vibration is a guide-rail bend or the like; the frequency of a vibration related to a guide rail is decided by the length of a single guide rail and the traveling speed of an elevator car. The length of a single guide rail is fixed for each elevator; thus, the frequency of a disturbance related to the guide rail changes depending on the traveling speed of the elevator car. A conventional elevator does not have a high traveling speed such that a disturbance, related to the guide rail, whose frequency is close to that of the second-mode vibration is caused; therefore, it has not been a crucial problem that no measures for reducing the second-mode vibration exist.

The objective of the present invention is to obtain a vibration damping system, for an elevator, which can suppress a transverse vibration of an elevator car when the elevator car travels at high speed.

Means for Solving the Problems

A vibration damping system, for an elevator, according to the present invention is provided with a damping device that is provided between a cab and a car frame for supporting the cab and whose damping coefficient can be changed; a speed detection means for detecting the traveling speed of a reference elevator car; and a calculation unit for receiving the traveling speed detected by the speed detection means, calculating a control signal for the damping device, and outputting the control signal to the damping device. The vibration damping system is characterized in that the calculation unit controls the damping device in such a way that, in the case where the traveling speed exceeds a predetermined value, the damping coefficient of the damping device is rendered larger than that in the case where the traveling speed is the same as or smaller than the predetermined value.

Moreover, a vibration damping system, for an elevator, according to the present invention is provided with a damping device that is provided between a cab and a car frame for supporting the cab and whose damping coefficient can be changed; a second damping device, which is mounted on the car frame and whose damping coefficient can be changed, for damping a vibration in which a guide roller that rotatably moves along a guide rail provided in a hoistway moves transversely; a speed detection means for detecting the traveling speed of a reference elevator car; a position detection means for detecting the position of the reference elevator car; a wind pressure anticipation means for anticipating a wind pressure to be exerted on the reference elevator car, by use of data on a fixed mutual-passing place, a speed detected by the speed detection means, and a position detected by the position detection means; and a calculation unit for receiving the output of the wind pressure anticipation means, calculating control signals for the damping device and the second damping device, and outputting the control signals to the damping device and the second damping device. The vibration damping system is characterized in that the calculation unit controls the damping device and the second damping device in such a way that, during duration in which the occurrence of a wind pressure is anticipated and predetermined durations immediately before and immediately after said duration, at least one of the respective damping coefficients of the damping device and the second damping device is rendered larger than that during duration other than said duration and the predetermined durations immediately before and immediately after said duration.

Still moreover, a vibration damping system, for an elevator, according to the present invention is provided with a damping device that is provided between a cab and a car frame for supporting the cab and whose damping coefficient can be changed; an actuator mounted on the car frame for controlling force that presses against a guide rail a guide roller that rotatably moves along the guide rail provided in a hoistway; a vibration sensor provided on the car frame; a speed detection means for detecting the traveling speed of a reference elevator car; a position detection means for detecting the position of the reference elevator car; a wind pressure anticipation means for anticipating a wind pressure to be exerted on the reference elevator car, by use of data on a fixed mutual-passing place, a speed detected by the speed detection means, and a position detected by the position detection means; and a calculation unit for receiving the output of the wind pressure anticipation means and a signal from the vibration sensor, calculating control signals for the damping device and the actuator, and outputting the control signals to the damping device and the actuator. The vibration damping system is characterized in that the calculation unit controls the actuator so as to suppress a vibration detected by the vibration sensor, and the calculation unit controlling the damping device in such a way that, during duration in which the occurrence of a wind pressure is anticipated and predetermined durations immediately before and immediately after said duration, the damping coefficient of the damping device is rendered larger than that during duration other than said duration and the predetermined durations immediately before and immediately after said duration.

Furthermore, a vibration damping system, for an elevator, according to the present invention is provided with an actuator mounted on the car frame for controlling force that presses against a guide rail a guide roller that rotatably moves along the guide rail provided in a hoistway; a second damping device, which is mounted on the car frame and whose damping coefficient can be changed, for damping a vibration in which the guide roller transversely moves; a vibration sensor provided on the car frame; a displacement detection means for detecting displacement which is the distance between the car frame and the guide rail; and a calculation unit for receiving a signal from the vibration sensor and displacement detected by the displacement detection means, calculating control signals for the second damping device and the actuator, and outputting the control signals to the second damping device and the actuator. The vibration damping system is characterized in that the calculation unit controls the second damping device and the actuator in such a way that, in the case where the product of the speed of a transverse vibration of the car frame obtained from acceleration detected by the vibration sensor and a displacement changing speed obtained from displacement detected by the displacement detection means is positive, the second damping device generates damping force, and in other cases, the actuator generates force for suppressing a vibration of the car frame.

Still furthermore, a vibration damping system, for an elevator, according to the present invention is provided with an actuator mounted on the car frame for controlling force that presses against a guide rail a guide roller that rotatably moves along the guide rail provided in a hoistway; a second damping device, which is mounted on the car frame and whose damping coefficient can be changed, for damping a vibration in which the guide roller transversely moves; a vibration sensor provided on the car frame; a displacement detection means for detecting displacement which is the distance between the car frame and the guide rail; and a calculation unit for receiving a signal from the vibration sensor and displacement detected by the displacement detection means, calculating control signals for the second damping device and the actuator, and outputting the control signals to the second damping device and the actuator. The vibration damping system is characterized in that the calculation unit controls the second damping device and the actuator in such a way that, in the case where the product of the speed of a transverse vibration of the car frame obtained from acceleration detected by the vibration sensor and a displacement changing speed obtained from displacement detected by the displacement detection means is positive, not only the second damping device generates damping force, but also the actuator generates force that is in proportion to the acceleration detected by the vibration sensor.

Advantage of the Invention

A vibration damping system, for an elevator, according to the present invention is provided with a damping device that is provided between a cab and a car frame for supporting the cab and whose damping coefficient can be changed; a speed detection means for detecting the traveling speed of a reference elevator car; a calculation unit for receiving the traveling speed detected by the speed detection means, calculating a control signal for the damping device, and outputting the control signal to the damping device. The vibration damping system is characterized in that the calculation unit controls the damping device in such a way that, in the case where the traveling speed exceeds a predetermined value, the damping coefficient of the damping device is rendered larger than that in the case where the traveling speed is the same as or smaller than the predetermined value; therefore, an effect is demonstrated in which, when the elevator travels at high speed, a vibration mode in which an antinode of a vibration falls within the space between the cab and the car frame can be suppressed.

Moreover, a vibration damping system, for an elevator, according to the present invention is provided with a damping device that is provided between a cab and a car frame for supporting the cab and whose damping coefficient can be changed; a second damping device, which is mounted on the car frame and whose damping coefficient can be changed, for damping a vibration in which a guide roller that rotatably moves along a guide rail provided in a hoistway moves transversely; a speed detection means for detecting the traveling speed of a reference elevator car; a position detection means for detecting the position of the reference elevator car; a wind pressure anticipation means for anticipating a wind pressure to be exerted on the reference elevator car, by use of data on a fixed mutual-passing place, a speed detected by the speed detection means, and a position detected by the position detection means; and a calculation unit for receiving the output of the wind pressure anticipation means, calculating control signals for the damping device and the second damping device, and outputting the control signals to the damping device and the second damping device. The vibration damping system is characterized in that the calculation unit controls the damping device and the second damping device in such a way that, during duration in which the occurrence of a wind pressure is anticipated and predetermined durations immediately before and immediately after said duration, at least one of the respective damping coefficients of the damping device and the second damping device is rendered larger than that during duration other than said duration and the predetermined durations immediately before and immediately after said duration; therefore, an effect is demonstrated in which, when a wind pressure is caused, a vibration can be suppressed.

Still moreover, a vibration damping system, for an elevator, according to the present invention is provided with a damping device that is provided between a cab and a car frame for supporting the cab and whose damping coefficient can be changed; an actuator mounted on the car frame for controlling force that presses against a guide rail a guide roller that rotatably moves along the guide rail provided in a hoistway; a vibration sensor provided on the car frame; a speed detection means for detecting the traveling speed of a reference elevator car; a position detection means for detecting the position of the reference elevator car; a wind pressure anticipation means for anticipating a wind pressure to be exerted on the reference elevator car, by use of data on a fixed mutual-passing place, a speed detected by the speed detection means, and a position detected by the position detection means; and a calculation unit for receiving the output of the wind pressure anticipation means and a signal from the vibration sensor, calculating control signals for the damping device and the actuator, and outputting the control signals to the damping device and the actuator. The vibration damping system is characterized in that the calculation unit controls the actuator so as to suppress a vibration detected by the vibration sensor, and the calculation unit controlling the damping device in such a way that, during duration in which the occurrence of a wind pressure is anticipated and predetermined durations immediately before and immediately after said duration, the damping coefficient of the damping device is rendered larger than that during duration other than said duration and the predetermined durations immediately before and immediately after said duration; therefore, an effect is demonstrated in which, when a wind pressure is caused, a vibration can be suppressed.

Furthermore, a vibration damping system, for an elevator, according to the present invention is provided with an actuator mounted on the car frame for controlling force that presses against a guide rail a guide roller that rotatably moves along the guide rail provided in a hoistway; a second damping device, which is mounted on the car frame and whose damping coefficient can be changed, for damping a vibration in which the guide roller transversely moves; a vibration sensor provided on the car frame; a displacement detection means for detecting displacement which is the distance between the car frame and the guide rail; and a calculation unit for receiving a signal from the vibration sensor and displacement detected by the displacement detection means, calculating control signals for the second damping device and the actuator, and outputting the control signals to the second damping device and the actuator. The vibration damping system is characterized in that the calculation unit controls the second damping device and the actuator in such a way that, in the case where the product of the speed of a transverse vibration of the car frame obtained from acceleration detected by the vibration sensor and a displacement changing speed obtained from displacement detected by the displacement detection means is positive, the second damping device generates damping force, and in other cases, the actuator generates force for suppressing a vibration of the car frame; therefore, an effect is demonstrated in which it is made possible to reduce a vibration, with power consumption less than that in the case where only the actuator 12 is employed.

Still furthermore, a vibration damping system, for an elevator, according to the present invention is provided with an actuator mounted on the car frame for controlling force that presses against a guide rail a guide roller that rotatably moves along the guide rail provided in a hoistway; a second damping device, which is mounted on the car frame and whose damping coefficient can be changed, for damping a vibration in which the guide roller transversely moves; a vibration sensor provided on the car frame; a displacement detection means for detecting displacement which is the distance between the car frame and the guide rail; and a calculation unit for receiving a signal from the vibration sensor and displacement detected by the displacement detection means, calculating control signals for the second damping device and the actuator, and outputting the control signals to the second damping device and the actuator. The vibration damping system is characterized in that the calculation unit controls the second damping device and the actuator in such a way that, in the case where the product of the speed of a transverse vibration of the car frame obtained from acceleration detected by the vibration sensor and a displacement changing speed obtained from displacement detected by the displacement detection means is positive, not only the second damping device generates damping force, but also the actuator generates force that is in proportion to the acceleration detected by the vibration sensor; therefore, an effect is demonstrated in which it is made possible to reduce a vibration with power consumption less than that in the case where only the actuator 12 is employed.

DESCRIPTION OF SYMBOLS

1: CAB
1A: PROTRUSION
2: CAR FRAME
2A: UPPER BEAM
2B: LOWER BEAM
2C: VERTICAL FRAME
2D: PROTRUSION
3: VIBRATION-PROOFING MATERIAL
4: VIBRATION PROOF RUBBER
5: DIRECT-ACTING DAMPER (DAMPING DEVICE)
5A: HOUSING
5B: MR FLUID
5C: FIXED YOKE
5D: PISTON
5E: COIL
5F: MOVING YOKE
5G: SPHERE
5H: SPHERE BEARING
5J: VISCOUS FLUID
6: GUIDE RAIL
7: BRACKET
8: HOISTWAY WALL
9: GUIDE DEVICE
9A: GUIDE BASE
9B: PIVOTAL AXLE
9C: GUIDE LEVER
9D: ROTATION AXLE
9E: GUIDE ROLLER
9F: SPRING
9G: ARM
10: ROPE
11: COUNTERWEIGHT
12: ACTUATOR
12A: MOVING PART
12B: FIXED PART
12C: COIL
13: PIVOT DAMPING DEVICE (SECOND DAMPING DEVICE)
13A: HOUSING
13B: MR FLUID
13C: COIL
13D: ROTOR
14: VIBRATION SENSOR
15: CONTROLLER (CALCULATION UNIT, WIND PRESSURE ANTICIPATION MEANS)
16: ADJACENT CAR
17: WIND PRESSURE
18: ORIFICE MECHANISM
18A: ORIFICE
18B: FIXED DISK
18C: ORIFICE
18B: MOVING DISK
18E: MOTOR
19: FRICTION MECHANISM
19A: SLIDING MEMBER
19B: SPRING

19C: MAGNETIC BODY
19D: IRON CORE
19E: COIL
20: FRICTION MECHANISM
20A: IRON CORE
20B: COIL
20C: MAGNETIC BODY
20D: SLIDING MEMBER
20E: SPRING
21: DIRECT-ACTING DAMPER (SECOND DAMPING DEVICE)
21A: ROTATIONAL BEARING
21B: ROTATIONAL BEARING
22: DISPLACEMENT GAUGE (DISPLACEMENT DETECTION MEANS)
23: BAND-PASS FILTER
24: INTEGRATOR
25: DIFFERENTIATOR
26: SWITCH
27: BAND-PASS FILTER
28: MULTIPLIER
29: ADDER

BEST MODE FOR CARRYING OUT THE INVENTION

Embodiment 1

Figure 1:
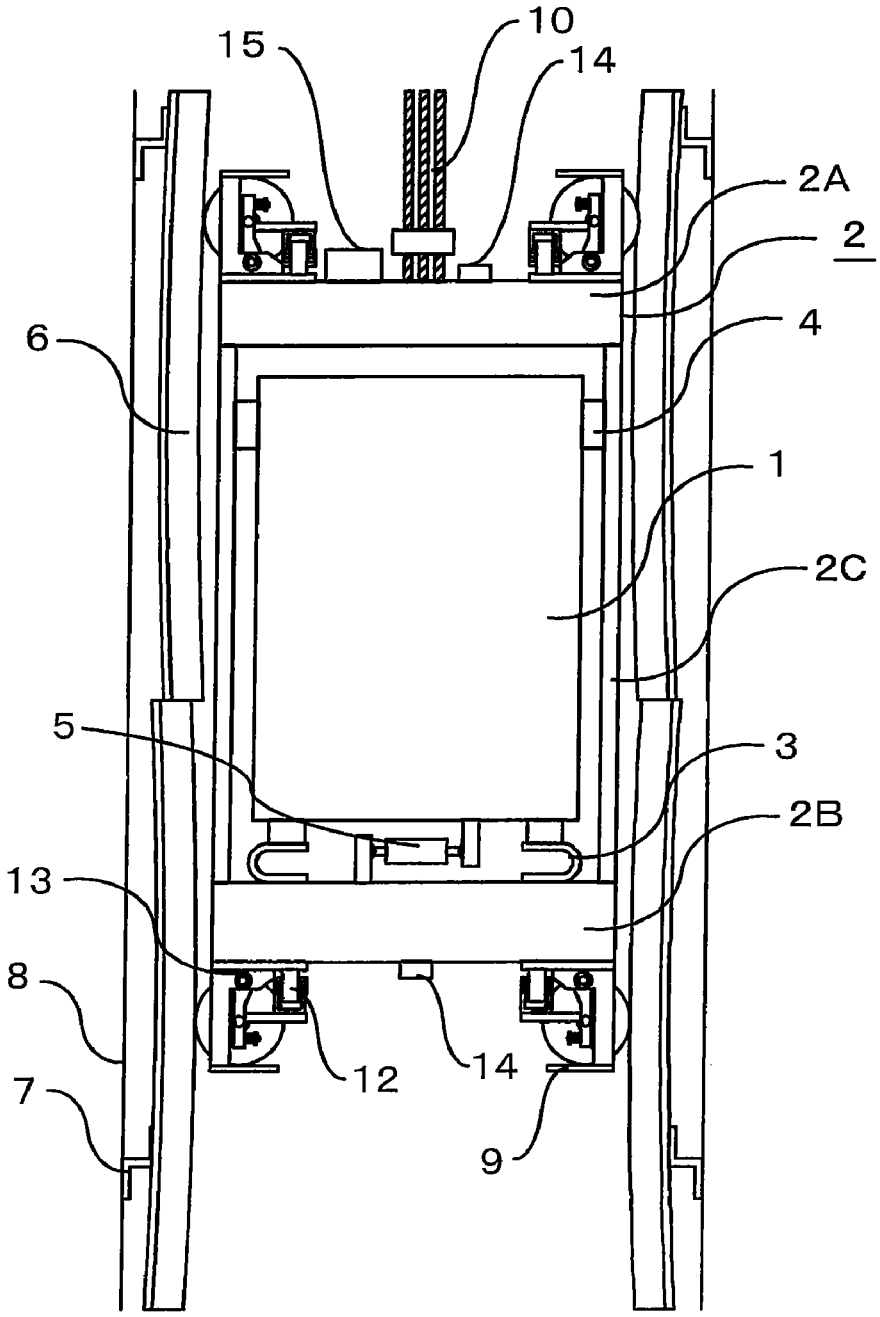
FIG. 1 is an overall elevator-car view for explaining the configuration of a vibration damping system, for an elevator, according to Embodiment 1 of the present invention.

FIG. 1 is an overall elevator-car view for explaining the configuration of a vibration damping system, for an elevator, according to Embodiment 1 of the present invention. In the elevator car, a cab 1 that accommodates passengers is supported by vibration-proofing materials 3 on a car frame 2 in such a way as to be movable to some extent. The car frame 2 is a rectangular frame including an upper beam 2A, a lower beam 2B, and two vertical frames 2C. Vibration proof rubbers 4 are provided between the cab 1 and the vertical frame 2*c* so as to prevent the cab 1 from inclining toward the vertical frame 2*c*. On the bottom surface of the cab 1, direct-acting dampers 5 are provided which damp a vibration through which the positional relationship, on the horizontal plane, between the cab 1 and the car frame 2 is changed. The direct-acting dampers 5 include a direct-acting damper, illustrated in FIG. 1, for damping a transverse vibration in the left-and-right direction and an unillustrated direct-acting damper for damping a transverse vibration in the back-and-forth direction. In FIG. 1, in order to avoid complexity, only the direct-acting damper for damping a transverse vibration in the left-and-right direction is illustrated. In addition, with the same mechanism as that of the direct-acting damper for damping a transverse vibration in the left-and-right direction, a transverse vibration in the back-and-forth direction can be suppressed.

The respective guide rails 6 are provided by the intermediary of brackets 7 on hoistway walls 8, in such a way as to face the corresponding sides of the car frame 2. A predetermined number of guide devices 9 for enabling the elevator to travel along the guide rails 6 are provided on the car frame 2. The guide devices 9 are situated at four positions, i.e., the top left, the top right, the bottom left, and the bottom right of the car frame 2. At each position, one guide device, which is in contact with the inner side of the guide rail 6 and guides the elevator car in the left-and-right direction, and two guide devices, which flank the guide rail 6 and guides the elevator car in the back-and-forth direction, are provided. In FIG. 1, only the guide device 9 that guides the elevator car in the left-and-right direction is illustrated.

The car frame 2 is pulled through a rope 10; an unillustrated hoisting machine winds the rope 10 so as to raise the elevator car and unwinds the rope 10 so as to lower the elevator car. In order to lighten the load on the hoisting machine, a counterweight 11 (unillustrated) having approximately the same weight as that of the elevator car is joined to the one end portion, of the rope 10, which is opposite to the other end portion, of the rope 10, to which the elevator car is joined. When the elevator car is raised, the counterweight 11 is lowered; when the elevator car is lowered, the counterweight 11 is raised. In order to minimize the space occupied by the elevator, the elevator car and the counterweight 11 are installed in such a way that they are extremely in the vicinity of each other.

Figure 2:
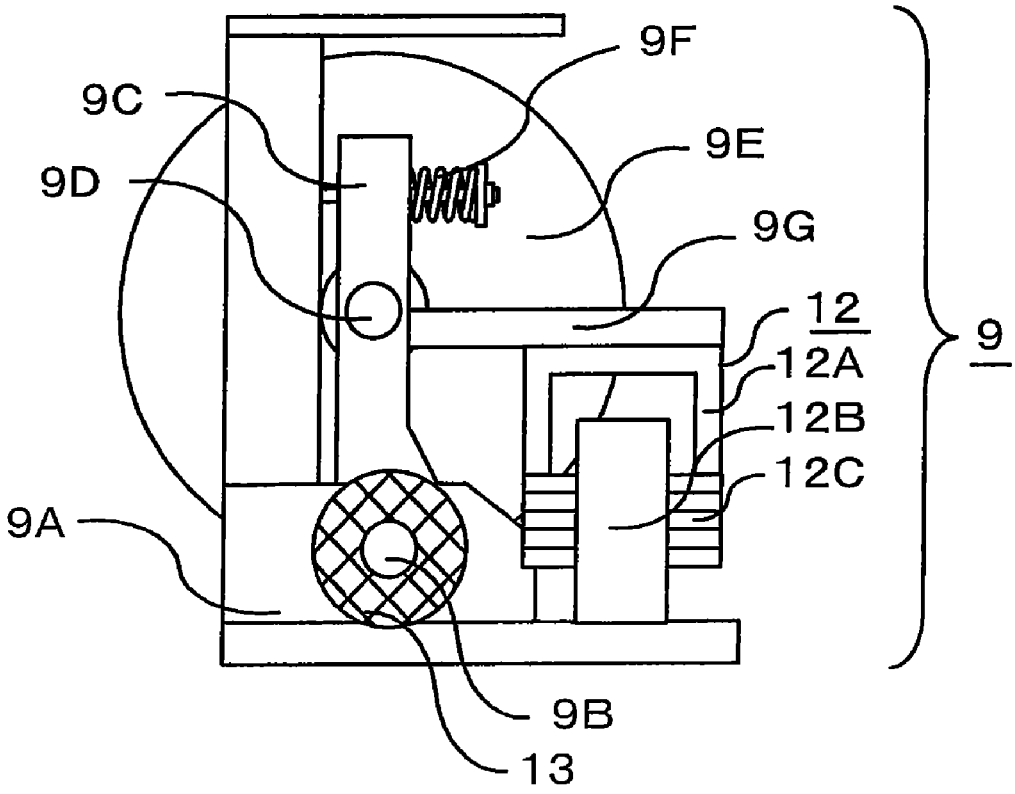
FIG. 2 is a view for explaining the structure of a guide device according to Embodiment 1 of the present invention.

FIG. 2 is a view for explaining the structure of the guide device 9. The guide device 9 is configured with a guide base 9A fixed to the car frame 2; a guide lever 9C mounted in a rockable manner on the guide base 9A, by the intermediary of a pivotal axle 9B; a guide roller 9E mounted rotatably on the guide lever 9C, by the intermediary of a rotation axle 9D; a spring 9F arranged in such a way that, in order to press the guide roller 9E against the guide rail 6, one end thereof is fixed at a predetermined position with respect to the guide base 9A and the other end is in contact with the guide lever 9C; and an arm 9G mounted through welding on the guide lever 9C in such a way as to be situated at a position that is slightly lower, in FIG. 2, than the rotation axle 9D for the guide lever 9C and to be perpendicular to the guide lever 9C. In addition, the guide base 9A is configured with a bottom-plate portion that is fixed to the car frame 2, a bearing portion having an opening into which the pivotal axle 9B is inserted, and a pillar portion in which a rod that penetrates through the spring 9F and fixes one end of the spring 9F thereon is mounted. At a predetermined position on the guide lever 9C, a through-hole having a predetermined size is provided so as to make the rod for fixing the one end of the spring 9F thereon penetrate thereinto.

When the guide roller 9E travels in the left-and-right direction, the guide lever 9C pivots on the pivotal axle 9B in a rocking manner, whereby the arm 9G travels in the top-and-bottom direction. An actuator 12 for controlling the force that presses the guide roller 9E against the guide rail 6 is provided between the arm 9G and the guide base 9A. A pivot damping device 13 for exerting damping force on the pivoting, of the guide lever 9C, with respect to the guide base 9A is provided on the pivotal axle 9B.

The configuration of the actuator 12 is the same as that set forth in Patent Document 1. A moving part 12A of the actuator 12 is fixed on the arm 9G; a fixed part 12B for generating a magnetic field that intersects the moving part 12A is fixed on the guide base 9A. The shape of the moving part 12A is a "U"-shape whose opened portion is oriented downward; a coil 12C is wound around the bottom portions of the moving part 12A. A through-hole, through which the coil 12C passes, is provided in the fixed part 12B; a permanent magnet is provided on the inner surface of the through-hole so as to generate a magnetic field whose direction is perpendicular to the coil 12C. When a current is applied to the coil 12C wound around the moving part 12A, a Lorentz force is exerted on the coil 12C that is in the magnetic field. The Lorentz force exerted on the coil 12C is exerted also on the moving part 12A. By controlling the current applied to the coil 12C in such a way that force that damps a light-and-left vibration of the guide roller 9E is exerted on the moving part 12A, the Lorentz force that is exerted on the coil 12C is controlled.

Figure 3:
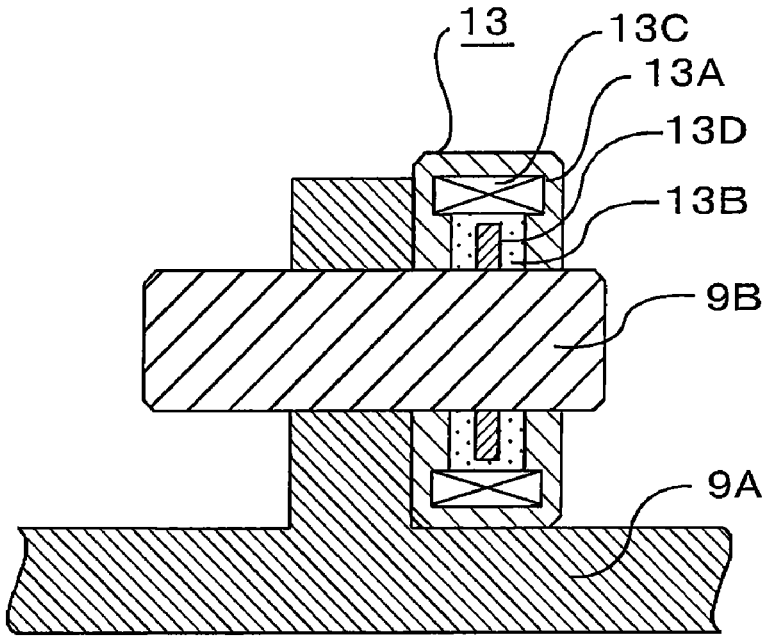
FIG. 3 is a view for explaining the structure of a pivot damping device according to Embodiment 1 of the present invention.

FIG. 3 is a longitudinal cross-sectional view for explaining the structure of the pivot damping device 13. The pivot damping device 13 is configured with a housing 13A, having a space whose cross section looks like a ring, which is fixed on the guide base 9A, with the pivotal axle 9B inserted through the guide base 9A; an MR fluid (Magneto-rheological fluid) 13B enclosed within the housing 13A; a coil 13C, fixed on the inner surface of the housing 13A, which generates a magnetic flux that crosses the housing 13A and the MR fluid 13B; and a disk-shaped rotor 13D that is fixed around the pivotal axle 9B and moves in a rotating manner in the MR fluid 13B. Between the inner side surfaces of the housing 13A, a gap is provided in which the rotor 13D is inserted. A sealing material that prevents the MR fluid 13B from leaking is provided for the space.

When no magnetic flux is generated, the respective resistances between the rotor 13D and the housing 13A and between the rotor 13D and the MR fluid 13B are made small so that the rotor 13D can freely move in a rotating manner. When a current is applied to the coil 13C so as to apply a magnetic field to the MR fluid 13B, the viscosity of the MR fluid 13B is raised, whereby the resistance between the MR fluid 13B and the rotor 13D increases, so that the rotor 13D cannot readily rotate. In other words, the pivot damping device 13 can damp a vibration in which the guide lever 9C pivots on the pivotal axle 9B in a rocking manner, i.e., a vibration in which the guide roller 9E travels transversely.

Figure 4:
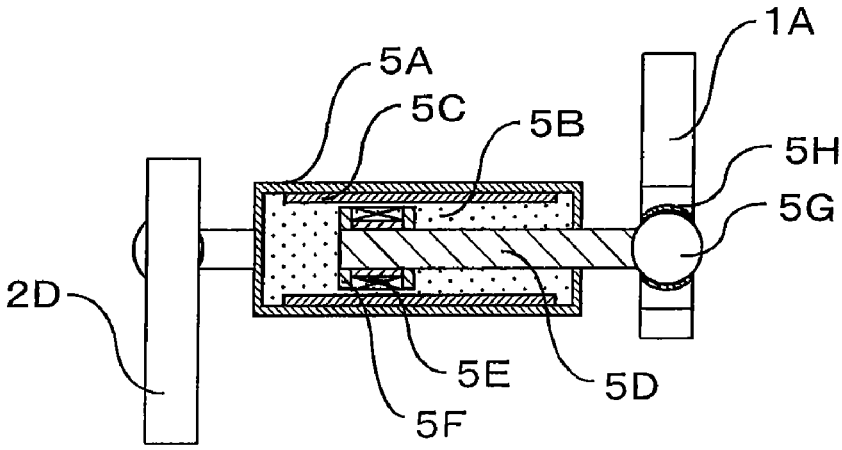
FIG. 4 is a view for explaining the structure of a direct-acting damper according to Embodiment 1 of the present invention.

FIG. 4 is a view for explaining the structure of the direct-acting damper 5. The direct-acting damper 5 also utilizes an MR fluid. The direct-acting damper 5 is configured with a cylindrical housing 5A; an MR fluid 5B enclosed within the housing 5A; a fixed yoke 5C that is fixed on the approximately whole inner surface of the housing 5A; a piston 5D that is inserted into the housing 5A, through an opening provided in one end face of the housing 5A; a coil 5E wound, in a predetermined width, around the distal portion of the piston 5D; and moving yokes 5F fixed on the piston 5D in such a way as to flank the coil 5E. A sealing material that prevents the MR fluid 5B from leaking is provided for the opening, of the housing 5A, through which the piston 5D is inserted.

The space between the coil 5E/the moving yokes 5F and the fixed yoke 5C is filled with the MR fluid 5B. When a current is applied to the coil 5E, a magnetic flux, i.e., a magnetic field that crosses the moving yokes 5F, the fixed yoke 5C, and the MR fluid 5B is generated. When the magnetic field is applied to the MR fluid 5B, the viscosity of the MR fluid 5B is raised, whereby the piston 5D cannot readily move in the MR fluid 5B. In addition, when no magnetic field is applied, the piston 5D can move in the MR fluid 5B, almost without any resistance.

Spheres 5G are formed at the respective ends of the housing 5A and the piston 5D. The sphere 5G at one end of the direct-acting damper 5 is pivotably mounted in a protrusion 1A in such a way as to be inserted in a sphere bearing 5H formed in the protrusion 1A provided beneath the cab 1; the sphere 5G at the other end of the direct-acting damper 5 is pivotably mounted in a protrusion 2D in such a way as to be inserted in a sphere bearing 5H formed in the protrusion 2D provided on the lower beam 2B. The respective heights of the protrusions 1A and 2D are adjusted in such a way that the direct-acting damper 5 is situated horizontally. The spheres 5G and the sphere bearings 5H are utilized; therefore, even though the positional relationship between the cab 1 and the car frame 2 is changed, the direct-acting damper 5 is disposed in the line that connects the protrusion 1A with the protrusion 2D, whereby a vibration in which the distance between the cab 1 and the car frame 2 is changed can be damped.

Vibration sensors 14 that detect the acceleration of a vibration of the car frame 2 are mounted on the upper surface of the upper beam 2A and on the lower surface of the lower beam 2B. A signal detected by the vibration sensor 14 is inputted to a controller 15 that is a calculation unit for controlling the actuators 12, the direct-acting damper 5, the pivot damping device 13, and the like. The controller 15 is disposed at a position that is appropriate to control the devices to be controlled. In Embodiment 1, the controller 15 is disposed on the upper surface of the upper beam 2A.

From the control apparatus of the reference elevator car in which the controller 15 is provided, the controller 15 receives information on the position, the traveling speed, and the like of the reference elevator car; in the case where an adjacent car exists, the controller 15 obtains information on the position, the traveling speed, and the like of the adjacent elevator car from the control apparatus of the adjacent elevator car. That is to say, the control apparatus of the reference elevator car is a position detection means as well as a speed detection means. The control apparatus of the adjacent elevator car is an adjacent-car traveling information obtaining means. Additionally, the controller 15 is also a wind pressure anticipation means for anticipating a wind pressure that is exerted on the reference elevator car.

This concludes the explanation for the structure; the operation will be explained hereinafter. A method of suppressing a left-and-right vibration, among transverse vibrations, of an elevator car will be explained. The same method can be applied also to a back-and-forth transverse vibration.

One of the principal factors that cause a transverse vibration of an elevator car is forced displacement excitation that is caused by a bend of the guide rail 6 or an error in installing joint portions thereof. The forced displacement excitation caused through the guide rail 6 is transferred to the car frame 2 and cab 1 by way of the guide device 9. Such a vibration disturbance caused through the guide rail 6 is characterized in that the excitation frequency fr[Hz], which is defined by Equation (1) below, based on the length lr[m] of one piece of the guide rail 6 and the traveling speed v[m/s] of an elevator car is dominant.

$$fr=v/lr \tag{1}$$

Figure 5:
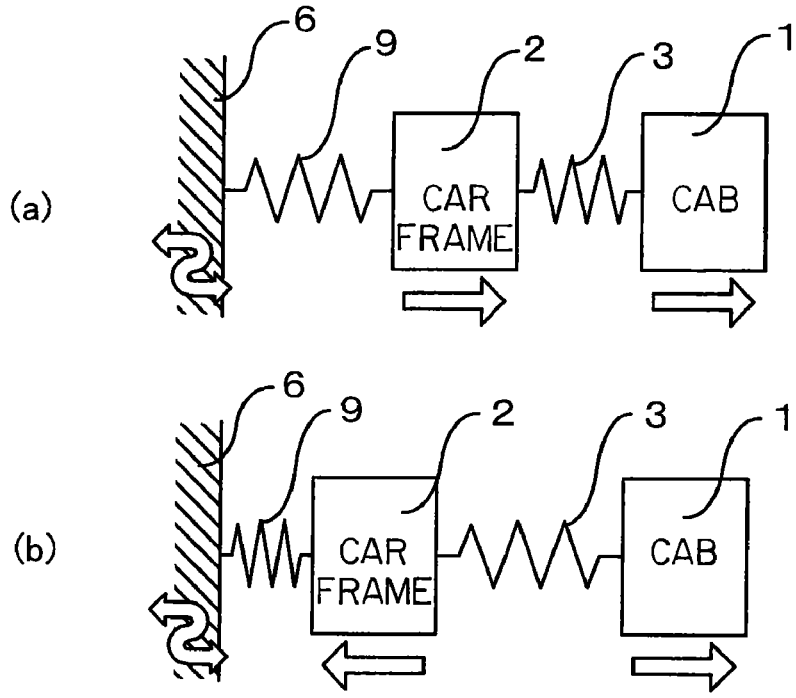
FIG. 5 is a set of diagrams for explaining inherent vibration modes of an elevator-car transverse vibration.

Meanwhile, the inherent vibration modes of a transverse elevator-car vibration are divided roughly into the two kinds of modes illustrated in FIG. 5. FIG. 5 is a set of diagrams for explaining the inherent vibration modes of a transverse elevator-car vibration. FIG. 5(*a*) illustrates a first mode, having a frequency of approximately 1.5 to 2.5[Hz], in which the antinode of a vibration falls within the space where the guide device 9 is provided. FIG. 5(*b*) illustrates a second mode, having a frequency of approximately 4 to 8[Hz], in which the cab 1 and the car frame 2 travel in respective directions that are opposite to each other and the antinode of a vibration falls within the space between the cab 1 and the car frame 2. In addition, the antinode of a vibration denotes the region or point where the amplitude of a vibration is maximal. In contrast, the node of a vibration denotes the region or point where the amplitude of a vibration is zero.

Figure 6:
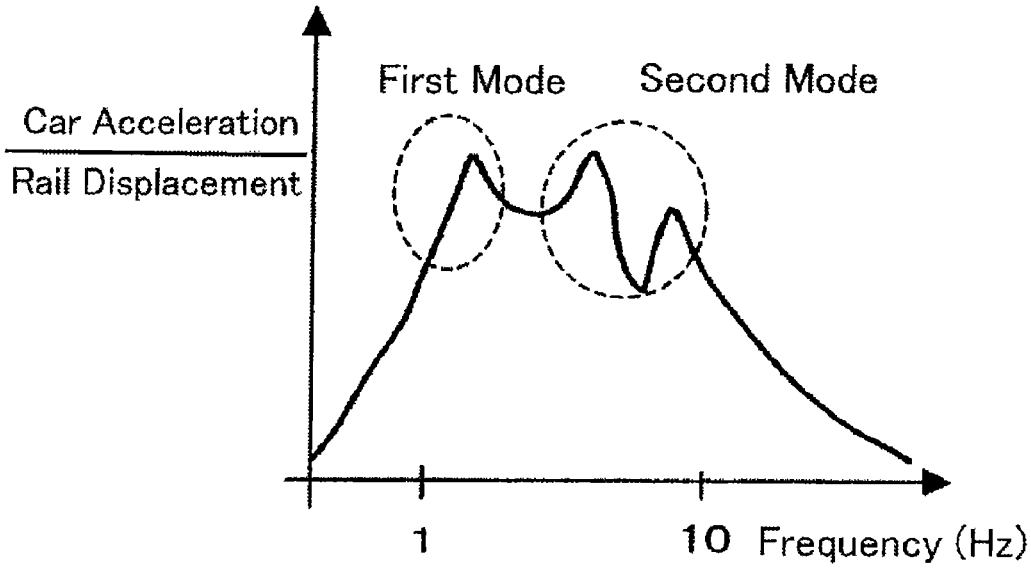
FIG. 6 is a graph for explaining an example of the frequency response of elevator-car displacement vs. the forced displacement disturbance from a guide rail.

FIG. 6 is a graph for explaining an example of the frequency response of elevator-car displacement vs. the forced displacement disturbance through a guide rail. FIG. 6 represents the value, obtained by dividing the acceleration value measured by the vibration sensor 14 by the displacement, versus the frequency, in the case where a vibration of a predetermined frequency and predetermined displacement is applied by the guide rail 6 to the car frame 2. It can be seen that the first mode and the second mode exist.

Assuming that the length lr of one piece of the guide rail 6 is 4 [m] as a typical value, the excitation frequency fr is the same as or lower than approximately 2.5 Hz, as far as the traveling speed v of the elevator car is under approximately 10 [m/s]; thus the excitation frequency fr is close to the frequency of the first mode. In the case where the elevator travels at such a traveling speed as exceeds approximately 16 [m/s], the excitation frequency fr becomes the same as or higher than 4 Hz, i.e., close to the frequency of the second mode.

Figure 7:
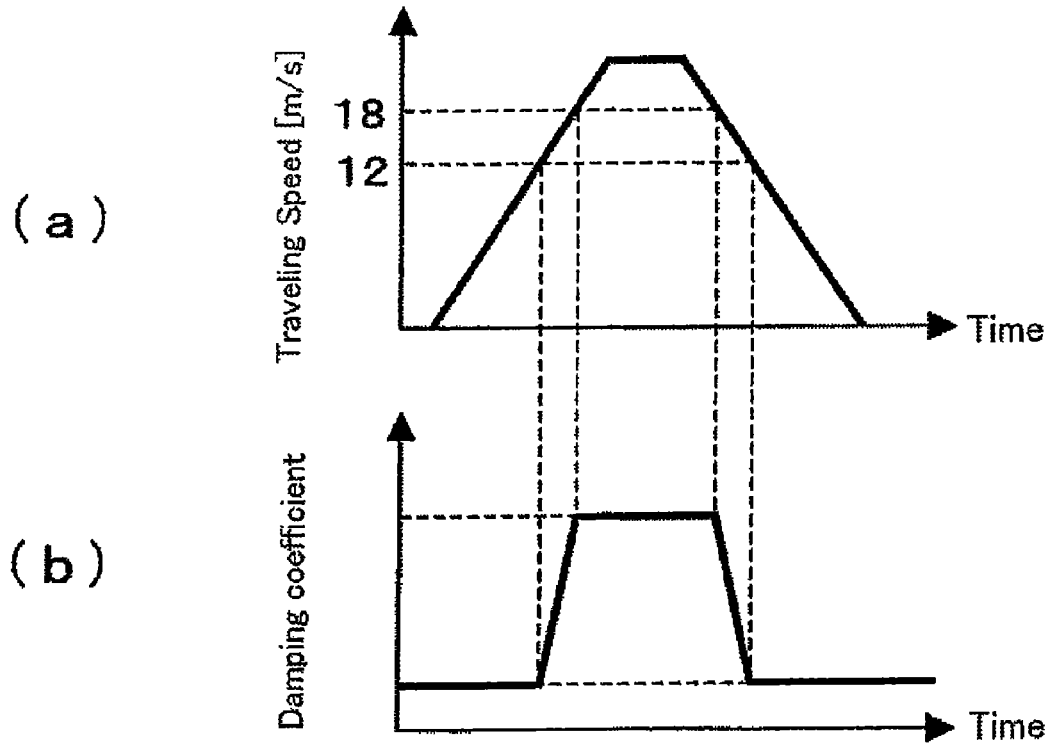
FIG. 7 is a set of graphs for explaining a method, according to Embodiment 1 of the present invention, of controlling the damping coefficient of a direct-acting damper in response to the traveling speed of an elevator car.

The signal detected by the vibration sensor 14 is inputted to the controller 15. In response to the traveling speed of the elevator car, the controller 15 controls the damping coefficient of the direct-acting damper 5 in such a way that the damping coefficient changes as represented in FIG. 7. FIG. 7 is a set of graphs for explaining a method, according to Embodiment 1, of controlling the damping coefficient of the direct-acting damper 5, in response to the traveling speed of an elevator car. FIG. 7(*a*) represents a change with time in the traveling speed of an elevator car. FIG. 7(*b*) represents a change with time in the damping coefficient of the direct-acting damper 5 vs. the change with time in the traveling speed of the elevator car, represented in FIG. 7(*a*). In addition, although not represented, the damping coefficient of the pivot damping device 13 is set to a minimal value, regardless of the traveling speed.

In the case where the traveling speed of the elevator car is the same as or lower than a predetermined speed (in this case, 12 [m/s]), a vibration is suppressed mainly by the actuator 12, with the damping coefficient of the direct-acting damper 5 set to be small. As a method of suppressing a vibration by use of the actuator 12, for example, the skyhook damping control is performed, although this method is not the nature of the present invention. A signal, which is obtained by applying filter processing to the horizontal-direction absolute speed calculated based on an acceleration signal detected by the vibration sensor 14, is inputted to the actuator 12; then, the actuator 12 generates force that is in proportional to the signal.

As the traveling speed of the elevator car becomes higher than 12 [m/s], the damping coefficient of the direct-acting damper 5 is gradually increased. When the traveling speed becomes the same as or higher than 18 [m/s], the damping coefficient of the direct-acting damper 5 is fixed at a maximal value. When the traveling speed decreases to be lower than 18 [m/s], the damping coefficient of the direct-acting damper 5 is gradually decreased. When the traveling speed becomes the same as or lower than 12 [m/s], the damping coefficient of the direct-acting damper 5 is fixed at a minimal value. Additionally, in FIG. 7, when the traveling speed is in the range from 12 [m/s] to 18 [m/s], the damping coefficient of the direct-acting damper 5 is linearly changed in response to the traveling speed. Because the traveling speed is adapted to linearly change with time, the damping coefficient also changes linearly with time. In addition, at the beginning and the ending of the change in the damping coefficient, the differential value of the changing speed may not become discontinuous. An arbitrary method, other than the method represented in FIG. 7, of changing the damping coefficient may be employed, as long as it is a method in which the damping coefficient in the case where the traveling speed of the elevator car is higher than a predetermined value is made to be larger than the damping coefficient in the contrary case, and no impact is exerted on the cab 1. The traveling speed of the elevator car, as an input for performing such control, may be either inputted from the control apparatus of the elevator or obtained through a calculation by the controller 15, based on the rotation speed of the guide roller 9E.

The operation of the direct-acting damper 5 will be explained in more detail below. When no current flows in the coil 5E of the direct-acting damper 5, the MR fluid 5B exhibits the characteristics of a low-viscosity fluid; therefore, the horizontal-direction movement, with respect to the housing 5A, of the piston 5D encounters almost no resistance. Accordingly, the damping coefficient becomes a small value. In contrast, when the controller 15 that has received a car-traveling-speed signal makes a current flow in the coil 5E of the direct-acting damper 5 in accordance with the relationship represented in FIG. 7, a flux path is formed through the moving yoke 5F, the MR fluid 5B, and the fixed yoke 5E. When a magnetic field is applied to the MR fluid 5B, the viscosity of the MR fluid 5B increases; therefore, the piston 5D has difficulty in moving through the space between the moving yoke 5F and the fixed yoke 5E; thus, the movement, with respect to the housing 5A, of the piston 5D encounters resistance. The resistance to the movement, with respect to the housing 5A, of the piston 5D serves as damping force; therefore, the larger is the current applied to the coil 5E, the larger becomes the damping coefficient. A relationship between the current applied to the coil 5E and the damping coefficient is obtained, and in accordance with the relationship, the current applied to the coil 5E is controlled, so that the damping coefficient is controlled.

As illustrated in FIG. 7, by enlarging the damping coefficient of the direct-acting damper 5, in the case where an elevator car has a speed (referred to as an "ultrahigh speed") in which the frequency fr of excitation caused through the guide rail becomes close to the frequency of the second-mode vibration, the second-mode vibration in which the cab 1 and the car frame 2 move in respective directions that are opposite to each other is suppressed. Then, the vibrations of the cab 1 and the car frame 2 are reduced by vibration-damping control utilizing the actuator 12. Additionally, in the case of the second-mode vibration, the node of the vibration approximately falls within the space in the vicinity of the guide device 9 in which the actuator 12 is provided; therefore, the second-mode vibration that is caused when the elevator car travels at ultrahigh speed cannot efficiently be reduced only by the actuator 12. In the case where the elevator car travels at low speed, the excitation frequency fr becomes close to the frequency of the first-mode vibration; because, in the first mode, the antinode of a vibration falls within the space in the vicinity of the guide device 9 in which the actuator 12 is provided, the vibration can efficiently be suppressed by the actuator 12. In the case where the elevator car travels at low speed, the respective damping coefficients of the direct-acting damper 5 and the pivot damping device 13 are small; therefore, the high-frequency components of a vibration hardly vibrates the cab 1, whereby a comfortable ride can be realized.

Figure 8:
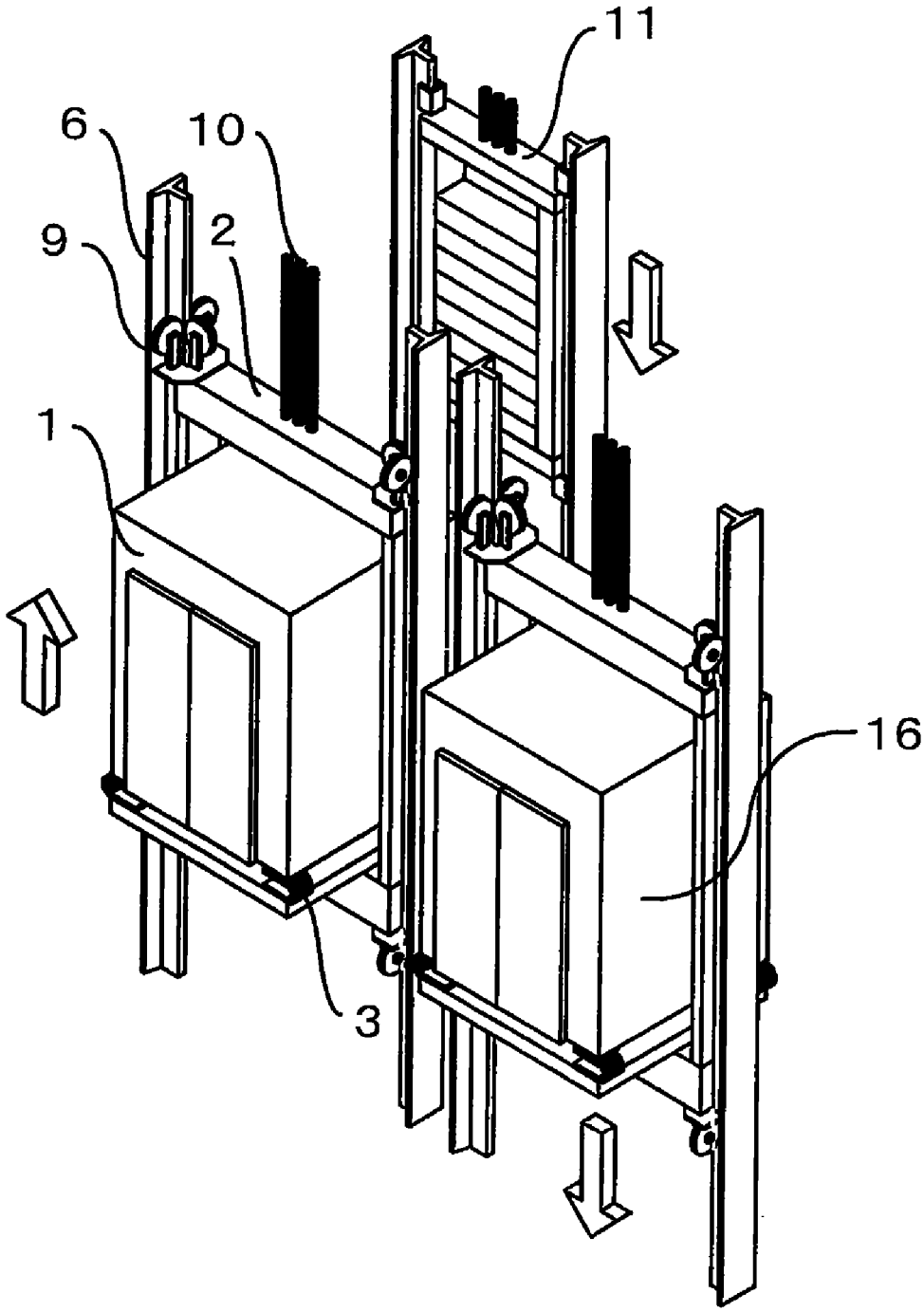
FIG. 8 is a view for explaining the cause of a wind pressure.

As an important factor to be taken into account in the case where an elevator car travels at high speed, a wind pressure that is directly exerted on the cab 1 and the car frame 2 is anticipated. As a factor that causes a wind pressure, mutual passing is conceivable in which the elevator car and the counterweight 11 pass each other or the elevator car and an adjacent elevator car pass each other. FIG. 8 is a view for explaining a cause of a wind pressure. As illustrated in FIG. 8, inside the elevator hoistway, the counterweight 11 travels immediately in the vicinity of the car. Because it is desirable that the space for the hoistway is small, the distance between the respective spaces in which the counterweight 11 and the car travel upward and downward is designed to be a critical mass; thus, approximately in the vicinity of the intermediate story, the car and the counterweight 11 pass each other in immediate proximity. When the speed at which the car and the counterweight 11 pass each other is high, a rapid and abrupt wind-pressure change is exerted to the car; therefore, the wind-pressure change causes a large transverse vibration of the car 1. As illustrated in FIG. 8, in the case where an adjacent car 16 and the reference car are installed within the same hoistway, a large wind-pressure change is caused also when the adjacent car 16 and the reference car pass each other. Because the adjacent car 16 is larger than the counterweight 11, the wind-pressure change when the reference car and the adjacent car 16 pass each other is larger than that when the reference car and the counterweight 11 pass each other. Furthermore, although not illustrated, also in the case where, due to various restrictions on the building, a place where the cross-sectional area abruptly changes exists within the hoistway, a car vibration is caused by a wind-pressure change when the car passes that place at high speed.

In the case where the elevator travels at high speed, it is presumed that the transverse vibration due to a wind-pressure change is extremely large in comparison with the transverse vibration, described above, due to a bend of the guide rail 6 or an error in installation. Accordingly, if the transverse vibration due to a wind-pressure change is required to be controlled by the actuator 12, the actuator 12 is compelled to be sizable and requires extremely large electric power, whereby it is difficult to realize the control by the actuator.

Figure 9:
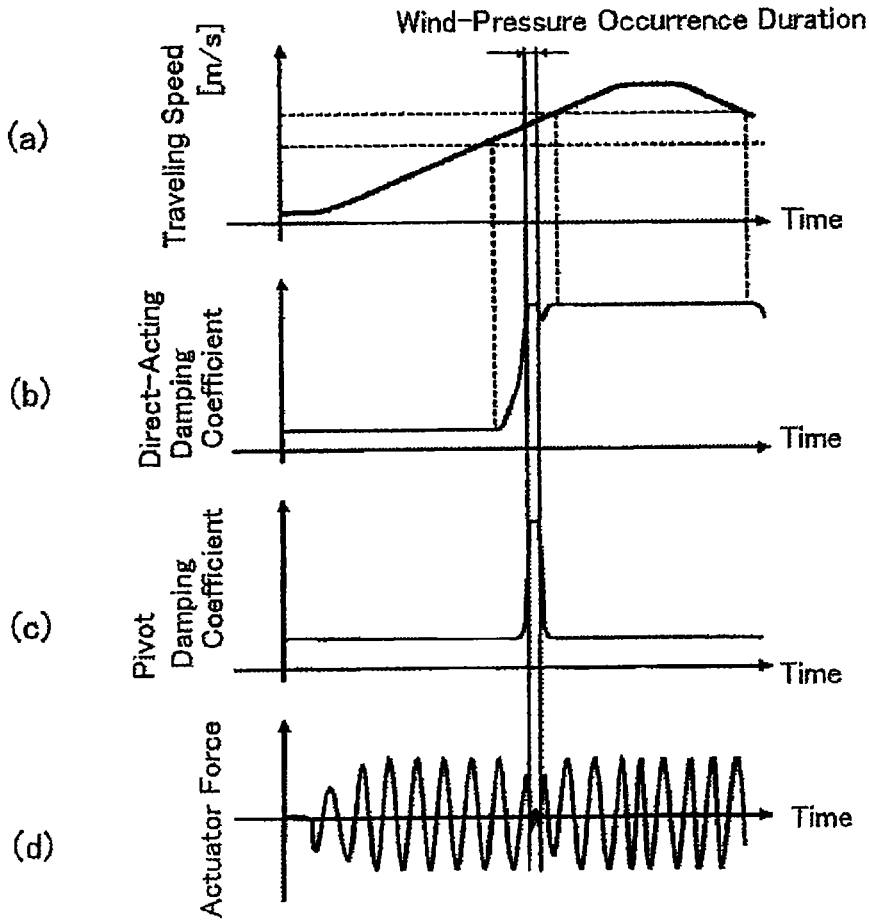
FIG. 9 is a set of graphs for explaining a method, according to Embodiment 1 of the present invention, of controlling an actuator, a direct-acting damper, and a pivot damping device for coping with a disturbance due to a wind-pressure change upon mutual passing.

A method of reducing a transverse vibration due to a wind pressure will be explained below. In order to reduce a transverse vibration due to a wind pressure, the pivot damping device 13 is disposed in parallel with the actuator 12. FIG. 9 is a set of graphs for explaining a method, of controlling the actuator 12, the direct-acting damper 5, and the pivot damping device 13, for coping with a disturbance caused by a wind-pressure change upon mutual passing. FIG. 9(*a*) represents the change with time in the traveling speed of the elevator car, especially in the case where the elevator is being accelerated. FIGS. 9(*b*), 9(*c*), and 9(*d*) represent the change with time in the damping coefficient of the direct-acting damper 5, the change with time in the damping coefficient of the pivot damping device 13, the change with time in the vibration-damping force generated by the actuator 12, respectively, in response to the change with time, represented in FIG. 9(*a*), in the traveling speed of the elevator car. The control method in the case where the traveling speed of the elevator car reaches an ultrahigh speed is the same as the method represented in FIG. 7. In addition to the control method represented in FIG. 7, the respective damping coefficients of the direct-acting damper 5 and the pivot damping device 13 are rendered maximal for the duration (referred to as a wind-pressure occurrence duration) in which a wind pressure is anticipated to be caused by mutual passing. Additionally, at the same time, the vibration-damping force of the actuator 12 is reduced. During a predetermined duration prior to the wind-pressure occurrence duration, the respective damping coefficients of the direct-acting damper 5 and the pivot damping device 13 are smoothly increased, and the proportionality coefficient of the vibration-damping force of the actuator 12 with respect to an input signal are smoothly decreased. During a predetermined duration after the wind-pressure occurrence duration, the respective damping coefficients of the direct-acting damper 5 and the pivot damping device 13 are smoothly decreased, and the proportionality coefficient of the vibration-damping force of the actuator 12 with respect to the input signal is smoothly increased.

The wind-pressure occurrence duration is calculated by the controller 15 in the following manner. In the case where a place where the cross-sectional area rapidly and abruptly changes exists in the hoistway, that place and the place where the elevator car and the counterweight 11 pass each other are referred to as "fixed mutual-passing places". Based on data pieces such as the length of the rope 10, the size of the counterweight 11, the height and the cross-sectional area of the hoistway, and the like, i.e., data related to the structure of the reference elevator, the positions of fixed mutual-passing places are obtained and stored as data in the controller 15 or the like. It is desirable that the data related to a fixed mutual-passing place is in a format suitable to process; however, an arbitrary format may be utilized, as long as, when the elevator passes the fixed mutual-passing place, the wind pressure can be presumably calculated. The controller 15 receives, from the control apparatus of the reference elevator car, signals related to traveling conditions such as the position and the speed of the reference elevator car, and then obtains the wind-pressure occurrence duration during which the elevator car travels in the vicinity of a fixed mutual-passing place at high speed (the same as or higher than a predetermined speed). The wind-pressure occurrence duration is designed to include an appropriate margin so as to absorb, for example, errors in the speed and the position.

In addition, in the case where other elevator cars exist in the hoistway, the controller 15 receives signals related to traveling conditions from the control apparatus of an adjacent elevator car and obtains the wind-pressure occurrence duration caused by the adjacent elevator car and the reference elevator car passing each other. Additionally, the case in which the reference elevator car stops at the floor level at which the adjacent car is at a standstill, the case in which the reference car passes a fixed mutual-passing place at a speed lower than a predetermined value, and the like are not categorized into the case of high-speed mutual passing. In contrast, the case, in which, even though the reference car is at a standstill or traveling at low speed, the adjacent car traveling at high speed and the reference car pass each other, is categorized into the case of high-speed mutual passing. The mutual-passing speed is also obtained concurrently with the wind-pressure occurrence duration. Additionally, a predetermined value for determining whether or not a mutual-passing speed is high is appropriately decided in consideration of an equation for the relationship between the mutual-passing speed and the wind pressure.

After the wind-pressure occurrence duration and the mutual-passing speed are obtained, the respective damping coefficients of the direct-acting damper 5 and the pivot damping device 13 are started to be increased and the coefficient of the actuator 12 is started to be decreased at the moment that is a predetermined time prior to the start of the wind-pressure occurrence duration so that these coefficients become predetermined values at the moment when the wind-pressure occurrence duration starts. During the wind-pressure occurrence duration, the foregoing conditions are maintained; at the end of the wind-pressure occurrence duration, the respective damping coefficients of the direct-acting damper 5 and the pivot damping device 13 are started to be decreased and the coefficient of the actuator 12 is started to be increased. Then, after a predetermined time has elapsed, the coefficients are restored to the values at the moment prior to the mutual passing, and then the values are maintained. However, in the case where, as represented in FIG. 9(*b*), the duration during which the damping coefficient of the direct-acting damper 5 is changed in response to the change in traveling speed of the elevator car and the wind-pressure occurrence duration overlap each other, the one value, out of the values obtained in accordance with the foregoing control methods, which is larger than the other is utilized as the damping coefficient.

The respective values of the damping coefficients and the coefficient value of the actuator 12 during the wind-pressure occurrence duration may be predetermined values that are independent of the mutual-passing speed or may be changed in response to the mutual-passing speed.

The predetermined time during which the damping coefficients and the like are changed may differ depending on whether the predetermined time is prior to the wind-pressure occurrence duration or after the wind-pressure occurrence duration, or may be changed in response to the mutual-passing speed. In addition, different predetermined times may be applied to the direct-acting damper 5, the pivot damping device 13, and the actuator 12. The increase or the decrease may be changed with time in a linear manner, or may be changed in such a way that the maximal value of the increase or the decrease rate in the changing speed is the same as or smaller than a predetermined value. In the case where, during the wind-pressure occurrence duration, the damping coefficients are the same as or larger than predetermined values and the coefficient of the actuator 12 is the same as or smaller than a predetermined value, the damping coefficients and the like may be changed during the wind-pressure occurrence duration. Taking the responsiveness, the vibration-suppression effect, and the like of the control apparatus into account, the method of controlling the damping coefficients and the like are decided for each of the wind-pressure occurrence duration and the time periods prior to and immediately after the wind-pressure occurrence duration.

Figure 10:
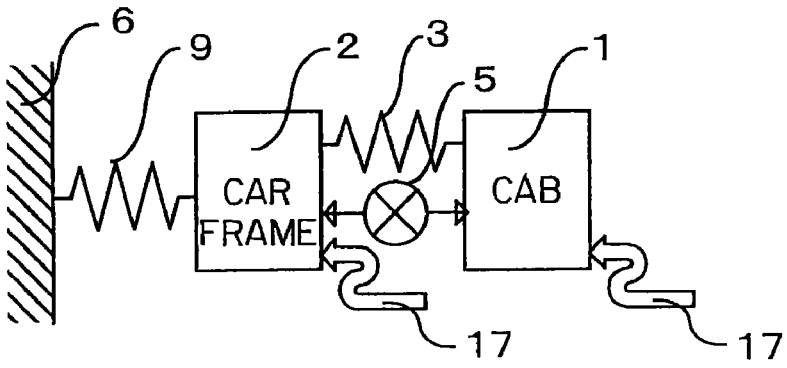
FIG. 10 is a simplified diagram of an elevator car on which a wind pressure 17 is exerted.

FIG. 10 is a simplified diagram of an elevator car on which a wind pressure 17 is exerted. In the case of the wind pressure 17 that is, as illustrated in FIG. 10, exerted directly on the cab 1 or the car frame 2, it is evident that, by enlarging the rigidity levels and the damping coefficients of the vibration-proofing material 3 and/or the direct-acting damper 5 and the guide device 9, the cab 1 becomes unlikely to vibrate. However, when the rigidity levels and the damping coefficients of the vibration-proofing material 3 and/or the direct-acting damper 5 and the guide device 9 are enlarged, the cab 1 becomes liable to vibrate, due to a transverse vibration, illustrated in FIG. 5, caused by a disturbance from the guide rail. A transverse vibration due to a wind pressure occurs within a time period, upon mutual passing, which is at longest several seconds and exerts, on the cab 1 and the like, several times as large force as a disturbance from the guide rail. Accordingly, the respective damping coefficients of the direct-acting damper 5 and the pivot damping device 13 are enlarged only for the duration during which the wind pressure is exerted. As a result, the transverse vibration upon the mutual passing can be reduced.

The actuator 12 and the pivot damping device 13 are disposed in parallel with each other; therefore, while the damping coefficient of the pivot damping device 13 is large, the car frame 2 hardly moves, even though the actuator 12 generates force to damp a vibration. Because a transverse vibration due to a wind pressure generates several times as large force as a transverse vibration through the guide rail, the force, to be generated by the actuator 12, for suppressing the vibration is beyond the ability of the actuator 12. Even though generating vibration-damping force at its full capacity, the actuator 12 cannot suppress the vibration; thus, the actuator 12 wastes electric power. In order to avoid the actuator 12 from wasting electric power, the coefficient of the actuator 12 is decreased during a wind-pressure occurrence duration. The actuator 12 may be adapted not to generate vibration-damping force during the wind-pressure occurrence duration.

The operation, upon the mutual passing, of the pivot damping device 13 will be explained in more detail. In the case where no current is applied to the coil 13C of the pivot damping device 13, the viscosity of the MR fluid 13B enclosed within the housing 13A is low; thus, the rotor 13D fixed around the pivotal axle 9B can pivot in the MR fluid 13B, almost without encountering any resistance, whereby the damping coefficient is small. When the controller 15 anticipates a wind-pressure change due to mutual passing or the like, a current is applied to the coil 13C, in accordance with a command from the controller 15. After the application of the current to the coil 13C, a flux path is formed through the housing 13A, the MR fluid 13B, and the rotor 13D. The application of the magnetic field to the MR fluid 13B raises the viscosity thereof; therefore, the damping coefficient is increased. The larger becomes the current applied to the coil 13C, the larger becomes the damping coefficient. The relationship between the current to be applied to the coil 13C and the damping coefficient is obtained, and, in accordance with the relationship, the current to be applied to the coil 13C is controlled, so that the damping coefficient is controlled.

Figure 11:
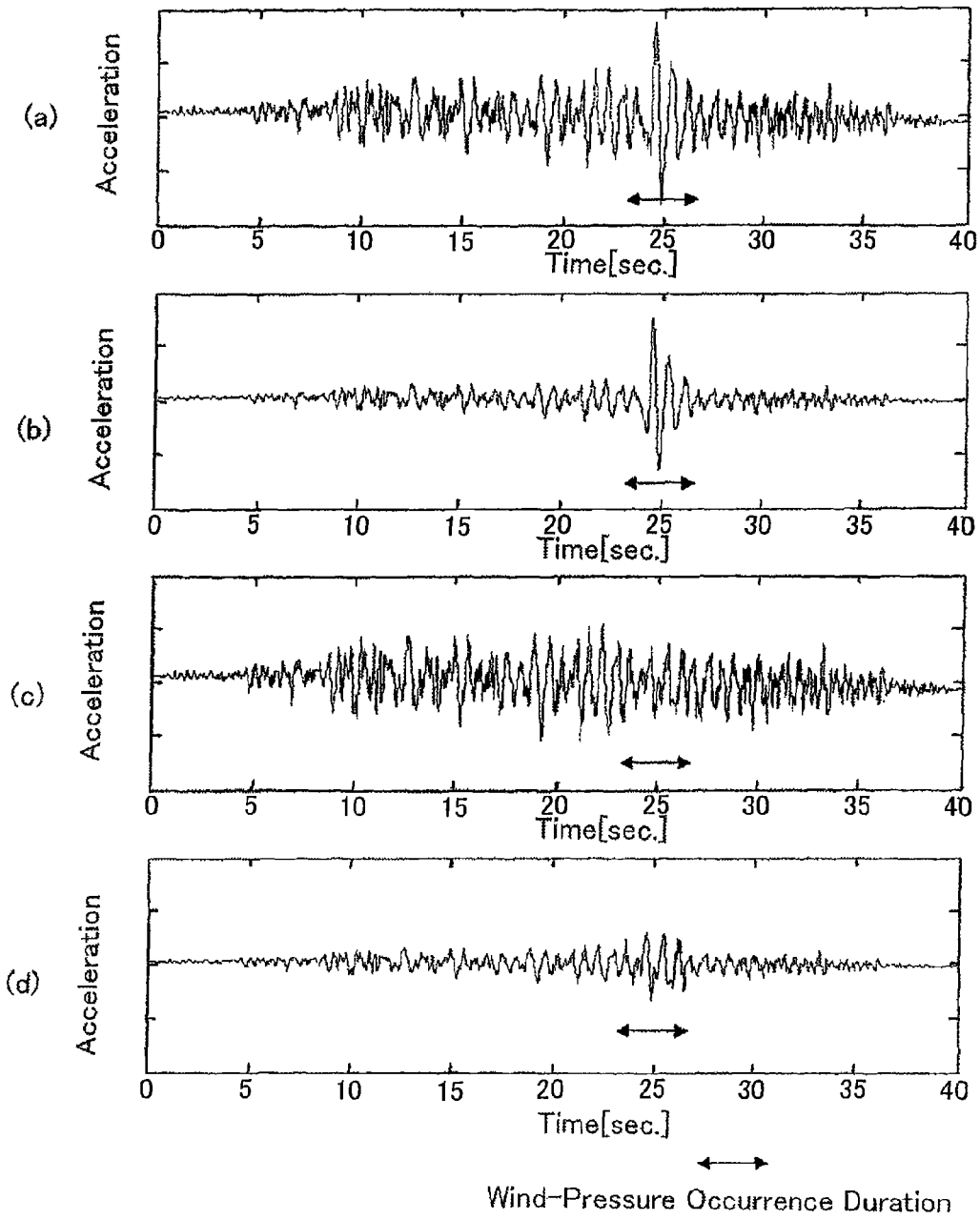
FIG. 11 is a set of graphs for explaining the results of simulations for comparing the vibration damping effect of Embodiment 1 of the present invention with the vibration damping effect of a conventional method.

FIG. 11 is a set of graphs for explaining the results of simulations for comparing the vibration damping effect of Embodiment 1 of the present invention with the vibration damping effect of a conventional method. FIG. 11 represents the respective waveforms, obtained through simulations, of transverse vibrations of the cab 1, in the case where several control methods are applied. FIG. 11(*a*) is a waveform in the case of a configuration (referred to as a "basic configuration") consisting only of the vibration-proofing material 3 and the guide device 9. FIG. 11(*b*) is a waveform in the case of a configuration consisting of the basic configuration and the actuator 12. Compared FIG. 11(*b*) with FIG. 11(*a*), the vibration in FIG. 11(*b*) is smaller than that in FIG. 11(*a*), except for a mutual-passing duration that is a wind-pressure occurrence duration during which a wind pressure occurs; therefore, it can be seen that the transverse vibration can be suppressed by the actuator 12. However, in FIG. 11(*b*), the vibration during the mutual passing is not made smaller.

FIG. 11(*c*) represents the case in which, by adding the direct-acting damper 5 and the pivot damping device 13 to the basic configuration, control in which the damping coefficients are enlarged during the mutual passing is performed. Compared FIG. 11(*c*) with FIG. 11(*b*), it can be seen that, in FIG. 11(*c*), the vibration during the mutual passing can be reduced. However, except for the mutual-passing duration, the vibration in FIG. 11(*b*) is smaller than that in FIG. 11(*c*). FIG. 11(*d*) represents the case in which, by adding the actuator 12, the direct-acting damper 5, and the pivot damping device 13 to the basic configuration, control in which the damping coefficients are increased and the coefficient of the actuator 12 is decreased during the mutual passing is performed. It can be seen that, in FIG. 11(*d*), the vibration during the normal traveling is reduced, as is the case with FIG. 11(*b*), by the actuator 12, and the vibration during the wind-pressure occurrence duration can be also reduced by the direct-acting damper 5 and the pivot damping device 13. Because, during the wind-pressure occurrence duration, the actuator 12 is adapted not to waste electric power, the transverse vibration due to a disturbance from the guide rail 6 remains; however, it can be seen that, from the comprehensive point of view, the vibration can be reduced most by the control method corresponding to FIG. 11(*d*).

As described above, the structural information on the hoistway and the elevator and the traveling condition of the reference car are inputted to the controller 15, the wind-pressure occurrence duration, which is a duration during which the elevator passes, at high speed, the fixed mutual-passing places including a place of mutual passing of the counterweight 11 and the elevator or a place at which the cross-sectional area of the hoistway changes rapidly and abruptly, is comprehended, and then the respective damping coefficients of the direct-acting damper 5 and the pivot damping device 13 are increased during the wind-pressure occurrence duration, so that a transverse vibration, of the cab 1, which is caused by a disturbance due to a wind-pressure change in the case where the elevator passes the fixed mutual-passing places at high speed, can be reduced. In addition, the control may be performed in such a way that, with the damping coefficient of one of the direct-acting damper 5 and the pivot damping device 13 rendered always large, the damping coefficient of the other damping device only is increased during the wind-pressure occurrence duration.

Furthermore, in the case where a plurality of cars travels in the same hoistway, the traveling condition of an adjacent car is inputted to the controller 15, the timing at which the adjacent car and the reference car pass each other at high speed is comprehended, and then the same control as that for the case in which the reference car and the counterweight 11 or the like pass each other is performed, so that a transverse vibration, of the cab 1, caused by a disturbance due to a wind-pressure change can be reduced also in the case where the reference car and the adjacent car pass each other at high speed. By performing the control in such a way that, during the wind-pressure occurrence duration, the vibration-damping force generated by the actuator 12 is rendered small, it is made possible to prevent the actuator 12 from operating and wasting electric power during the wind-pressure occurrence duration.

The MR fluid can provide large damping force under the condition of low voltage and small current, thereby enabling to provide larger vibration-damping force, with small electric power dissipated, than other means can provide. Moreover, the MR fluid has an advantage in that, because its reproducibility coefficient of the relationship between the control current applied to the coil and the damping coefficient to be generated is larger than those of other means, whereby the damping coefficient can readily be controlled.

The foregoing explanation also applies to other embodiments.

Embodiment 2

In Embodiment 2, the structure of the direct-acting damper 5 is changed so that an orifice mechanism is utilized to replace the MR fluid. Embodiment 2 is the same as Embodiment 1, except for the structure of a direct-acting damper 5.

Figure 12:
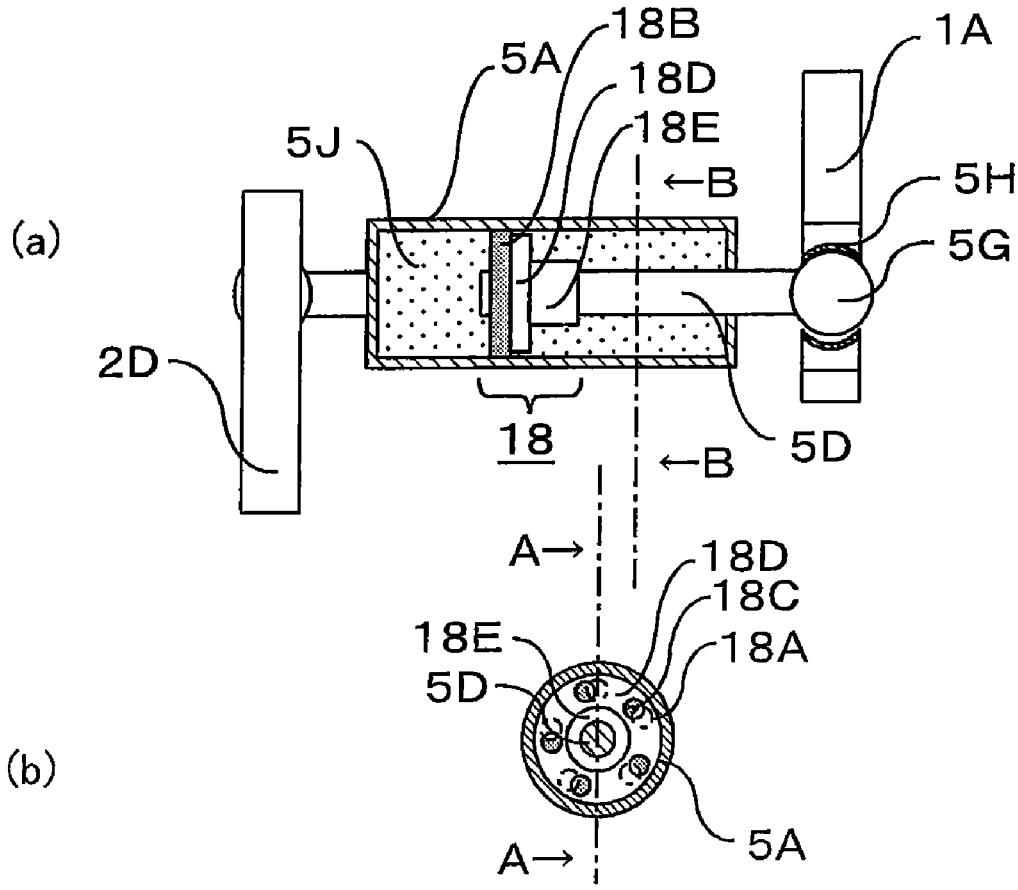
FIG. 12 is a set of views for explaining the structure of a direct-acting damper according to Embodiment 2 of the present invention.

FIG. 12 is a set of views for explaining the structure of the direct-acting damper 5 according to Embodiment 2. FIG. 12(*a*) is a longitudinal cross-sectional view taken along the plane that passes the center of a piston 5D and is parallel to the piston 5D; FIG. 12(*b*) is a transverse cross-sectional view. In addition, the cross-sectional view taken along the line A-A in FIG. 12(*b*) corresponds to FIG. 12(*a*); the cross-sectional view taken along the line B-B in FIG. 12(*a*) corresponds to FIG. 12(*b*).

The direct-acting damper 5 includes a cylindrical housing 5A, the piston 5D that is inserted into the housing 5A in a horizontally movable manner, a viscous fluid 5J that has an approximately constant viscosity and is enclosed in the housing 5A, and an orifice mechanism 18 mounted on the front end of the piston 5D. The opening trough which the piston 5D is inserted into the housing 5A is provided with an unillustrated appropriate member for preventing the viscous fluid 5J from leaking outside. The method of pivotably fixing the housing 5A and the piston 5D on the cab 1 or the car frame 2 is the same as that in Embodiment 1.

The orifice mechanism 18 includes a fixed disk 18B having a predetermined number of orifices 18A of a predetermined diameter, a moving disk 18D having orifices 18C that are similar to those in the fixed disk 18B, and a motor 18E that rotates the moving disk 18D. The fixed disk 18B and the moving disk 18D are adhered to each other; the centers of the pivotal axes of the fixed disk 18B, the moving disk 18D, and the motor 18E coincide with the center of the cross section of the piston 5D. The respective numbers and the respective diameters of the orifices 18A and the orifices 18C are adjusted in such a way that, when the moving disk 18D rotates, the orifices 18A are cut off by the moving disk 18D and the orifices 18C are cut off by the fixed disk 18B.

Next, the operation will be explained.

The control of the direct-acting damper 5, a pivot damping device 13, and an actuator 12 is performed in the same manner as in Embodiment 1. Embodiment 2 is the same as Embodiment 1, except for the operation of changing the damping coefficient of the direct-acting damper 5.

In the normal mode in which the damping coefficient is rendered minimal, the orifices 18A and the orifices 18C are made to coincide with each other. In this situation, the viscous fluid 5J can readily pass through the orifices 18A and the orifices 18C; therefore, when moving in the horizontal direction, the piston 5D encounters little resistance. In other words, the damping coefficient of the direct-acting damper 5 becomes minimal.

In order to increase the damping coefficient, the moving disk 18D is pivoted through the motor 18E so that the area in which the orifices 18A and the orifices 18C overlap each other, i.e., the fluid-passing opening is diminished. FIG. 12(*b*) illustrates the foregoing situation. In the case where the fluid-passing opening is small, when passing through the fluid-passing opening, the viscous fluid 5J encounters resistance, whereby the piston 5D cannot readily move in the horizontal direction. In other words, the damping coefficient of the direct-acting damper 5 is increased. As described above, by pivoting the moving disk 18D through the motor 18E, thereby changing the area of the fluid-passing opening, the damping coefficient of the direct-acting damper 5 can be controlled. The relationship between the pivoting angle of the moving disk 18D and the damping coefficient is preliminarily obtained, and based on the relationship, the pivoting angle of the moving disk 18D is controlled so that a predetermined damping coefficient is realized.

Embodiment 2 demonstrates the same effect as Embodiment 1 does.

Viscous fluids having an approximately constant viscosity have many usage records in various fields; a damping device utilizing a viscous fluid and an orifice mechanism has an advantage in that it is superior to a damping device utilizing an MR fluid, in terms of reliability such as a lifetime. However, it is more difficult to control the damping coefficient of a damping device utilizing a viscous fluid and an orifice mechanism than to control the damping coefficient of a damping device utilizing an MR fluid.

Embodiment 3

Figure 13:
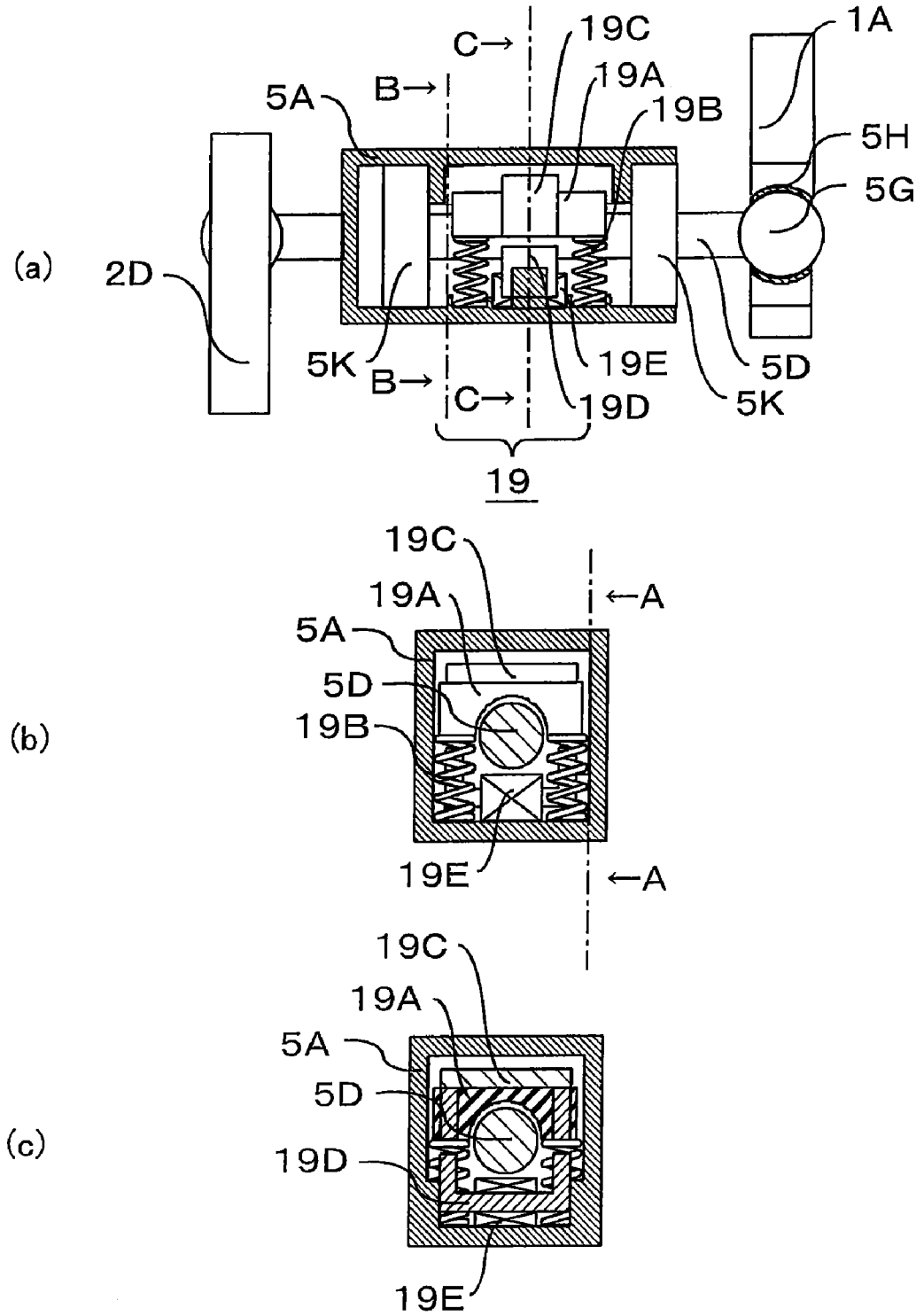
FIG. 13 is a set of views for explaining the structure of a direct-acting damper according to Embodiment 3 of the present invention.

In Embodiment 3, the structure of a direct-acting damper 5 is changed so that a friction mechanism is utilized to replace the MR fluid. Embodiment 3 is the same as Embodiment 1, except for the structure of the direct-acting damper FIG. 13 is a set of views for explaining the structure of the direct-acting damper 5 according to Embodiment 3. FIG. 13(*a*) is a longitudinal cross-sectional view taken along the plane that is located immediately inside a housing 5A; FIG. 13(*b*) is a transverse cross-sectional view; FIG. 13(*c*) is a transverse cross-sectional view taken along a plane different from that in FIG. 13(*b*). In addition, the cross-sectional view taken along the line A-A in FIG. 13(*b*) corresponds to FIG. 3(*a*); the cross-sectional view taken along the line B-B in FIG. 13(*a*) corresponds to FIG. 13(*b*); the cross-sectional view taken along the line C-C in FIG. 13(*a*) corresponds to FIG. 13(*c*).

As can be seen from FIG. 13, the direct-acting damper 5 includes a housing 5A having a contour of a rectangular parallelepiped; a rod-shaped piston 5D that is inserted into the housing 5A and whose cross section is circular; two sliding bearings 5K, provided at predetermined positions in the housing 5A, which hold the piston 5D movably in the horizontal direction; and a friction mechanism 19, provided between the sliding bearings 5K, which applies frictional force to the piston 5D. FIG. 13(*b*) is a transverse cross-sectional view of the direct-acting damper 5 as viewed in such a way as to look the friction mechanism 19 from immediate vicinity of the friction mechanism 19; FIG. 13(*c*) is a transverse cross-sectional view of the direct-acting damper 5 taken along the plane located at the middle of the friction mechanism 19.

The friction mechanism 19 includes a sliding member 19A, having a contour of a rectangular parallelepiped provided with a semicircular groove at the bottom side thereof, which applies frictional force to the piston 5D; four springs 19B one end of each of which is fixed to the housing 5A and that support the sliding member 19A so that the sliding member 19A does not come into contact with the piston 5D; a magnetic body 19C fit from top into grooves provided in the middle-top surface and both side surfaces of the sliding member 19A; an iron core 19D fixed to the housing 5A in such a way as to face the magnetic body 19C; and a coil 19E wound around the iron core 19D. The distance between the iron core 19D and the magnetic body 19C is set in such a way that, when a current is applied to the coil 19E, the iron core 19D can attract the magnetic body 19C and, in the state in which the iron core 19D attracts the magnetic body 19C, the sliding member 19A is pressed against the piston 5D. Other structures in Embodiment 3 are the same as those in Embodiment 1.

Next, the operation will be explained.

The control of the direct-acting damper 5, a pivot damping device 13, and an actuator 12 is performed in the same manner as in Embodiment 1. Embodiment 3 is the same as Embodiment 1, except for the operation of changing the damping coefficient of the direct-acting damper 5.

In the normal mode in which the damping coefficient is rendered minimal, the sliding member 19A is supported by the springs 19B so as not to come into contact with the piston 5D. When the controller 15 issues a command of increasing the damping coefficient, a current is applied to the coil 19E. After the application of the current to the coil 19E, a flux path is formed through the iron core 19D and the magnetic body 19C, whereby the iron core attracts the magnetic body 19C and the sliding member 19A. Then, the sliding member 19A is pressed against the piston 5D, whereby frictional force occurs between the sliding member 19A and the piston 5D; the frictional force serves as damping force to impede the movement, in the horizontal direction, of the piston 5D. The larger is the current applied to the coil 19E, the larger becomes the frictional force; the larger is the frictional force, the larger becomes the damping force. In other words, by controlling the current to be applied to the coil 19E, the damping coefficient can be controlled.

Embodiment 3 demonstrates the same effect as Embodiment 1 does.

The damping device utilizing the friction mechanism demonstrates an effect in which no MR fluid or viscous fluid is required to be enclosed in the housing, whereby the structure of the damping device is simplified. However, it is more difficult to control the damping coefficient of the damping device utilizing a viscous fluid than to control the damping coefficient of a damping device utilizing an MR fluid or a viscous fluid.

Embodiment 4

In Embodiment 4, the structure of the pivot damping device 13 is changed so that a friction mechanism is utilized to replace the MR fluid. Embodiment 4 is the same as Embodiment 1, except for the structure of a pivot damping device 13.

Figure 14:
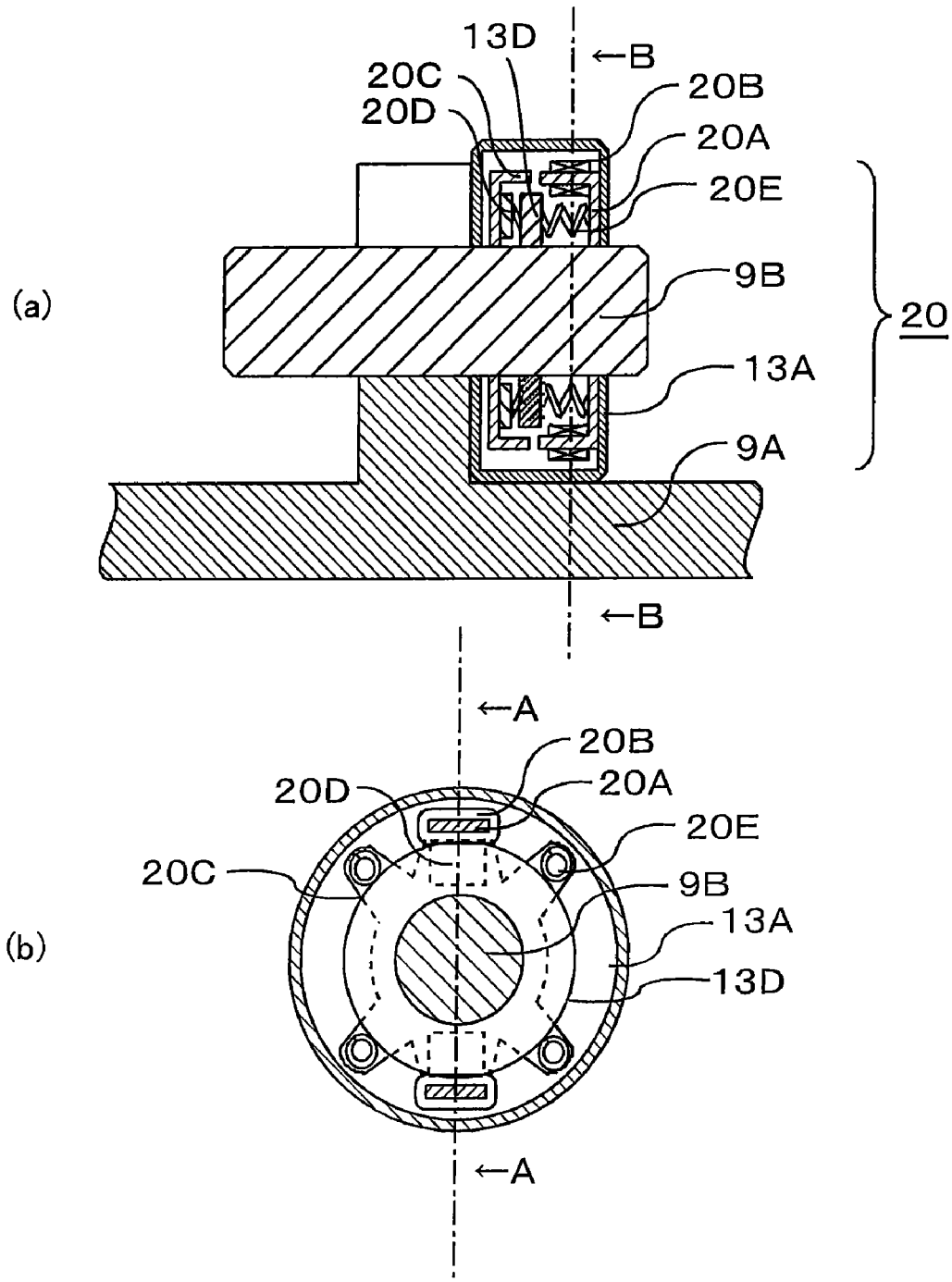
FIG. 14 is a set of views for explaining the structure of a pivot damping device according to Embodiment 4 of the present invention.

FIG. 14 is a set of views for explaining the structure of the pivot damping device 13 according to Embodiment 4. FIG. 14(*a*) is a longitudinal cross-sectional view taken along the plane that passes the center of a pivotal axle 9B; FIG. 14(*b*) is a transverse cross-sectional view. In addition, the cross-sectional view taken along the line A-A in FIG. 14(*b*) corresponds to FIG. 3(*a*); the cross-sectional view taken along the line B-B in FIG. 14(*a*) corresponds to FIG. 3(*b*).

As can be seen in FIG. 14, the pivot damping device 13 utilizing a friction mechanism includes a friction mechanism 20 to replace the MR fluid 13B and the coil 13C. A housing 13A and a rotor 13D have the same structures as those in Embodiment 1 have. The friction mechanism 20, whose face fixed to the housing 13A has a shape of a circle, having an opening through which the pivotal axle 9B passes, to the top and the bottom of which rectangles are connected, is configured with an iron core 20A having portions, of a predetermined length, which are bent by 90° from the corresponding distal ends of the top and bottom rectangles; a coil 20B wound around the iron core 20A; a magnetic body 20C that is attracted by the iron core 20A when a current is applied to the coil 20B; two sliding members 20D that is mounted on one side, of the magnetic body 20C, facing the rotor 13D and that generates frictional force when making contact with the rotor 13D; and four springs 20E that hold the magnetic body 20C and the sliding members 20D so that, when no current is applied to the coil 20B, the sliding members 20D do not make contact with the rotor 13D. The shape of the magnetic body 20C is in such a way that four portions that make contact with the springs 20E and the top and bottom portions that are attracted by the iron core 20A appear outside the diameter of the rotor 13D. The top and bottom portions that are attracted by the iron core 20A are bent by 90° from the rest portion, as is the case with the iron core 9A. The distance between the iron core 20A and the magnetic body 20C is set in such a way that, when a current is applied to the coil 20B, the iron core 20A can attract the magnetic body 20C, and in the state in which the iron core 20A attracts the magnetic body 20C, the sliding member 20D is pressed against the rotor 13D. Other structures in Embodiment 4 are the same as those in Embodiment 1.

Next, the operation will be explained.

The control of the direct-acting damper 5, a pivot damping device 13, and an actuator 12 is performed in the same manner as that in Embodiment 1 is performed. Embodiment 4 is the same as Embodiment 1, except for the operation of changing the damping coefficient of the pivot damping device 13.

In the normal mode in which the damping coefficient is rendered minimal, the sliding member 20D is supported by the springs 20E so as not to come into contact with the rotor 13D. When the controller 15 issues a command of increasing the damping coefficient, a current is applied to the coil 20B. After the application of the current to the coil 20B, a flux path is formed through the iron core 20A and the magnetic body 20C, whereby the iron core 20C attracts the magnetic body 20C and the sliding member 20D. Then, the sliding member 20D is pressed against the rotor 13D, whereby frictional force occurs between the sliding member 20D and the rotor 13D; the frictional force serves as damping force to impede the rotation of the rotor 13D. The larger is the current applied to the coil 20B, the larger becomes the frictional force; the larger is the frictional force, the larger becomes the damping force. In other words, by controlling the current to be applied to the coil 20B, the damping coefficient can be controlled.

Embodiment 4 demonstrates the same effect as Embodiment 1 does.

In the pivot damping device 13 as well as the direct-acting damper 5, the damping device utilizing the friction mechanism demonstrates an effect in which no MR fluid or viscous fluid is required to be enclosed in the housing, whereby the structure thereof is simplified. However, it is more difficult to control the damping coefficient of the damping device utilizing the friction mechanism than to control the damping coefficient of a damping device utilizing an MR fluid or a viscous fluid.

Embodiment 5

Embodiment 5 is obtained by modifying Embodiment 1 in such a way that, in order to damp a vibration between the guide roller 9E and the car frame 2, a direct-acting damper is provided to replace the pivot damping device 13.

Figure 15:
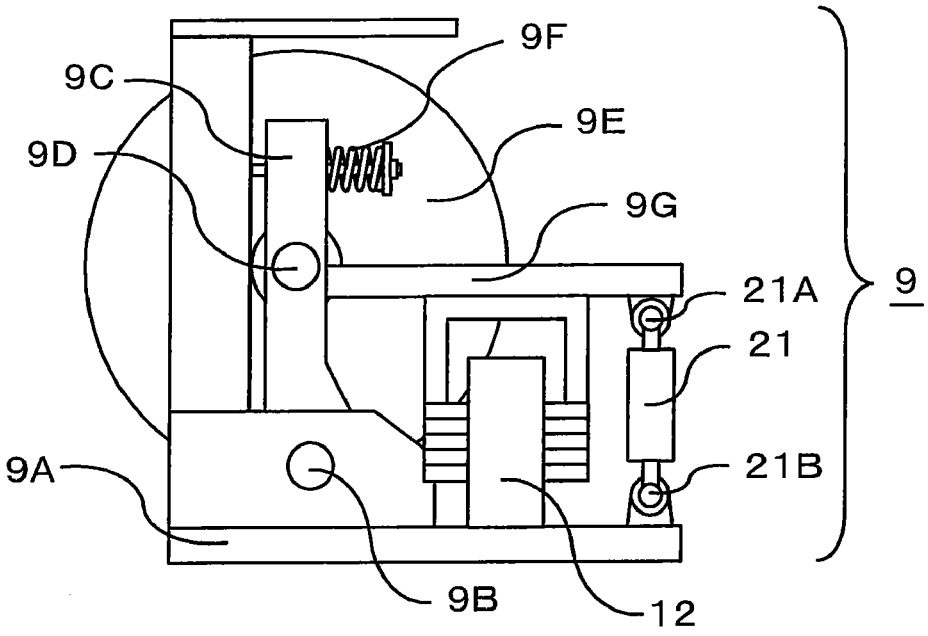
FIG. 15 is a view for explaining the structure of a guide device according to Embodiment 5 of the present invention.

FIG. 15 is a view for explaining the structure of a guide device according to Embodiment 5. A direct-acting damper 21, which damps a vibration caused by the guide roller 9E being pressed and moved by the guide rail 6, is provided, in parallel with the actuator 12, between an arm 9G of a guide device 9 and a guide base 9A; however, the pivot damping device 13 is not provided. One end of the direct-acting damper 21 is pivotably connected to the arm 9G by the intermediary of a rotational bearing 21A; the other end of the direct-acting damper 21 is pivotably connected to the guide base 9A by the intermediary of a rotational bearing 21B. The structure of the direct-acting damper 21 is designed to be the same as that of the direct-acting damper 5 that damps a vibration between the car frame 2 and the cab 1. As a result, an effect is demonstrated in which the number of components can be reduced.

Embodiment 5 demonstrates the same effect as Embodiment 1 does.

The respective structures of the direct-acting dampers 21 and the direct-acting damper 5 may be in such a way that, as is the case with Embodiment 1, an MR fluid is utilized, in such a way that, as is the case with Embodiment 2, a viscous fluid is utilized, or in such a way that, as is the case with Embodiment 3, a friction mechanism is utilized.

Embodiment 6

Figure 16:
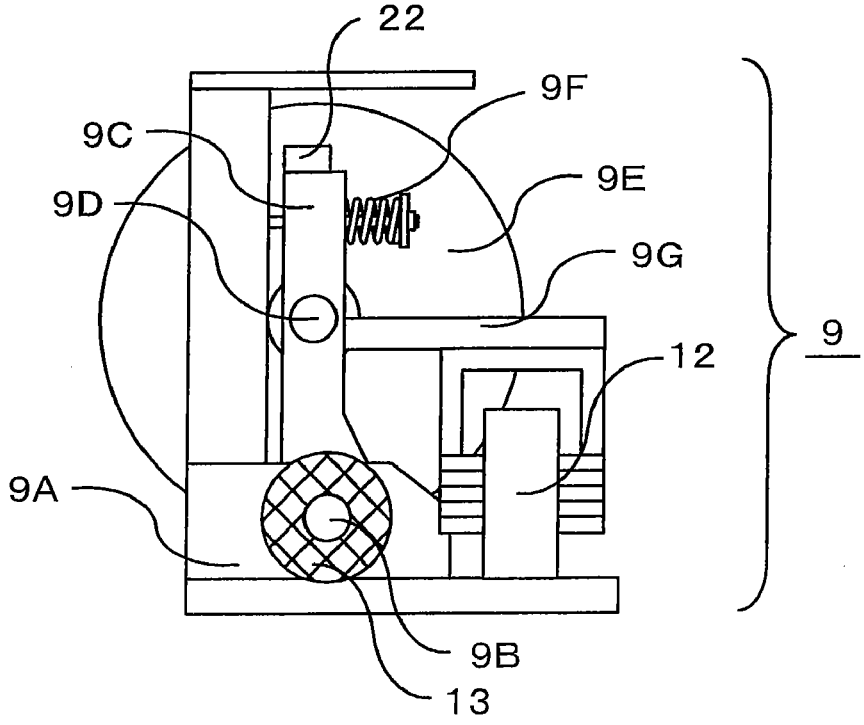
FIG. 16 is a view for explaining the structure of a guide device according to Embodiment 6 of the present invention.

Embodiment 6 is obtained by modifying Embodiment 1 in such a way that, a displacement gauge, which is a displacement detection means for measuring the distance, i.e., the displacement between the guide rail 6 and the car frame 2, is provided to be utilized for controlling the damping coefficient. FIG. 16 is a view for explaining the configuration of a guide device 9, according to Embodiment 6, in a vibration damping system for an elevator. A displacement gauge 22, which measures displacement, is provided on the top portion of the guide lever 9C. In addition, the method of control performed by the controller 15 is different; therefore, a computing unit and the like required to realize the control method are changed. Other structures in Embodiment 6 are the same as those in Embodiment 1.

Figure 17:
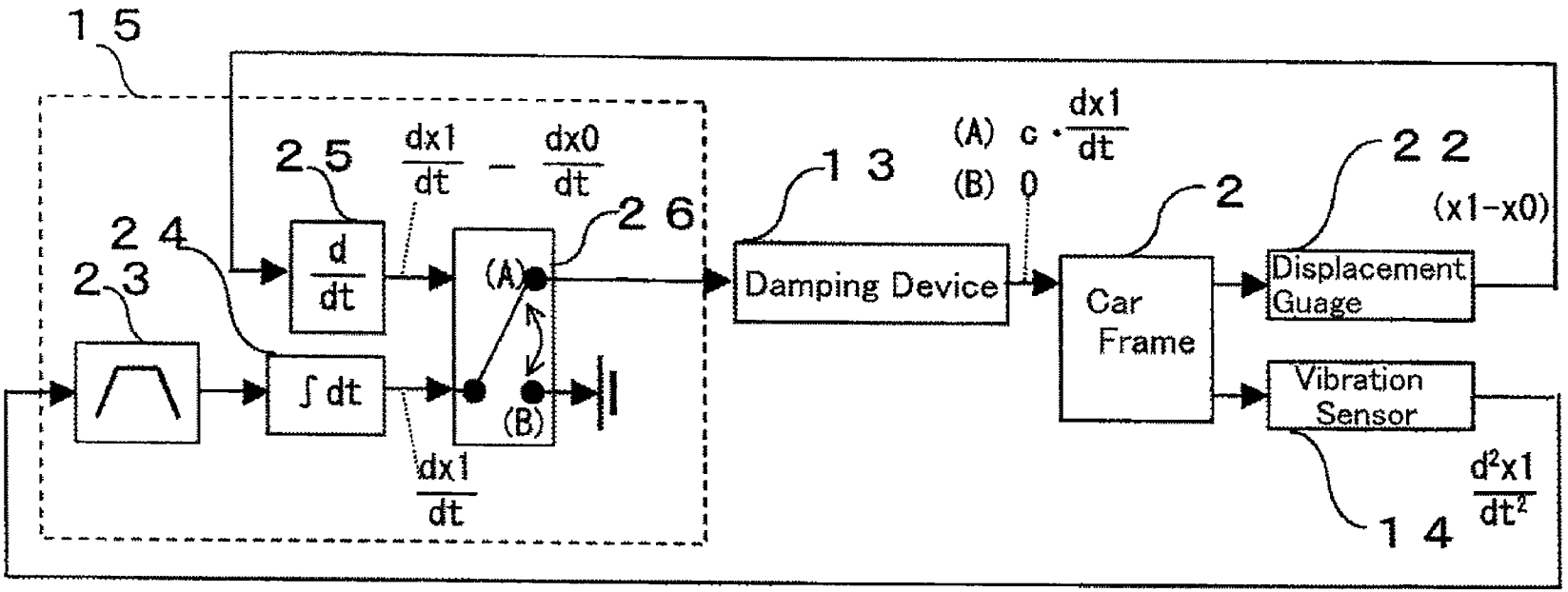
FIG. 17 is a block diagram for explaining a conventional control method to be compared with a control method according to Embodiment 6 of the present invention.
Figure 18:
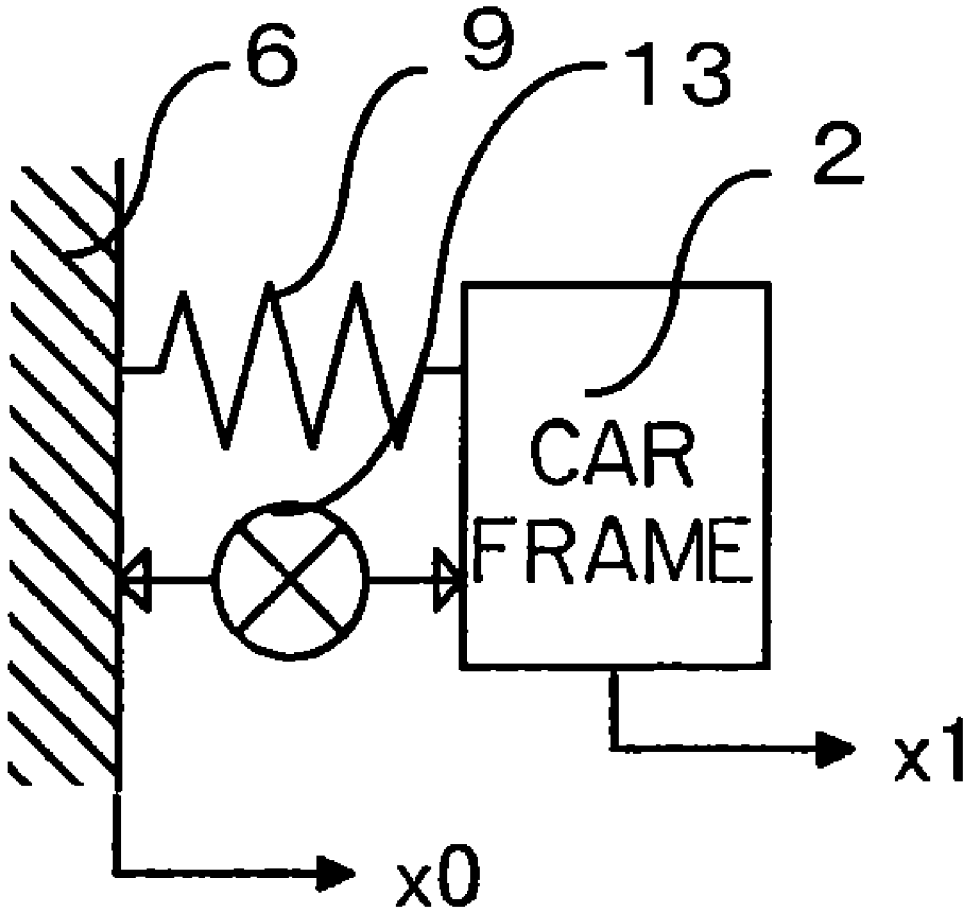
FIG. 18 is a diagram for describing variables utilized for explaining a control method according to Embodiment 6 of the present invention.

Next, the operation will be explained. In the first place, a conventional control method in which the skyhook damping control is realized by use of a damping device will briefly be explained. FIG. 17 is a block diagram for explaining the conventional control method in which the skyhook damping control is realized by use of a damping device. Additionally, FIG. 18 is a diagram for explaining variables for describing the control method. The transverse position of the guide rail 6 is represented by a variable x0 and the transverse position of the car frame 2 is represented by a variable x1.

Inside the controller 15, low-frequency and high-frequency components, which are unnecessary for the control, are eliminated through a band-pass filter 23 from the horizontal-directional absolute acceleration ($d^2x1/dt^2$), of the car frame 2, measured by the vibration sensor 14. The output signal from the band-pass filter 23 is integrated by an integrator 24, so that a horizontal-directional absolute speed signal (dx1/dt) for the car frame 2 is generated; the damping coefficient of the pivot damping device 13 is controlled so that the pivot damping device 13 can generate vibration-damping force to reduce the speed, in proportion to the horizontal-directional absolute speed signal. In this regard, however, the pivot damping device 13 generates damping force that damps a changing speed (dx1/dt−dx0/dt) of the distance between the car frame 2 and the guide rail 6, i.e., the displacement; therefore, in order to exert vibration-damping force $f_d$ (=c*(dx1/dt)) for suppressing the vibration on the car frame 2, only in the case where the direction of the changing speed of displacement coincides with the direction of the vibration-damping force to be exerted, by differentiating by a differentiator 25 the distance between the car frame 2 and the guide rail 6, i.e., the displacement (x1−x0), measured by the displacement gauge 22, a displacement changing speed signal (dx1/dt−dx0/dt) is generated.

Receiving the horizontal-directional absolute speed signal (dx1/dt) for the car frame 2 and the displacement changing speed signal (dx1/dt−dx0/dt), a switch 26 calculates the damping coefficient cg of the pivot damping device 13 in accordance with the cases classified as follows: In addition, in the case of (B), the two vertical lines situated on the right side of the arrow that designates the output of the switch 26 suggest that the output signal of the switch 26 is not utilized but terminated; thus, in the case of (B), the pivot damping device 13 does not generate any damping force.

(A) In the case where (dx1/dt−dx0/dt)*(dx1/dt)>0, $$f_d=c*(dx1/dt) \tag{2}$$

$$cg=c*((dx1/dt)/(dx1/dt-dx0/dt)) \tag{3}$$

(B) In the case where (dx1/dt−dx0/dt)*(dx1/dt)≦0, $$f_d=0 \tag{4}$$

$$cg=0 \tag{5}$$

In such a method as described above, when (dx1/dt)≠0, (dx1/dt−dx0/dt)=0; therefore, in the case where the case is switched from (A) to (B) or from (B) to (A), the vibration-damping force generated by the pivot damping device 13 changes instantaneously and considerably. Accordingly, the control method whose block diagram is illustrated in FIG. 17 has a problem in that, even though the displacement, of the car frame 2, due to a vibration can be suppressed to a small level, the acceleration of the vibration cannot be diminished.

Figure 19:
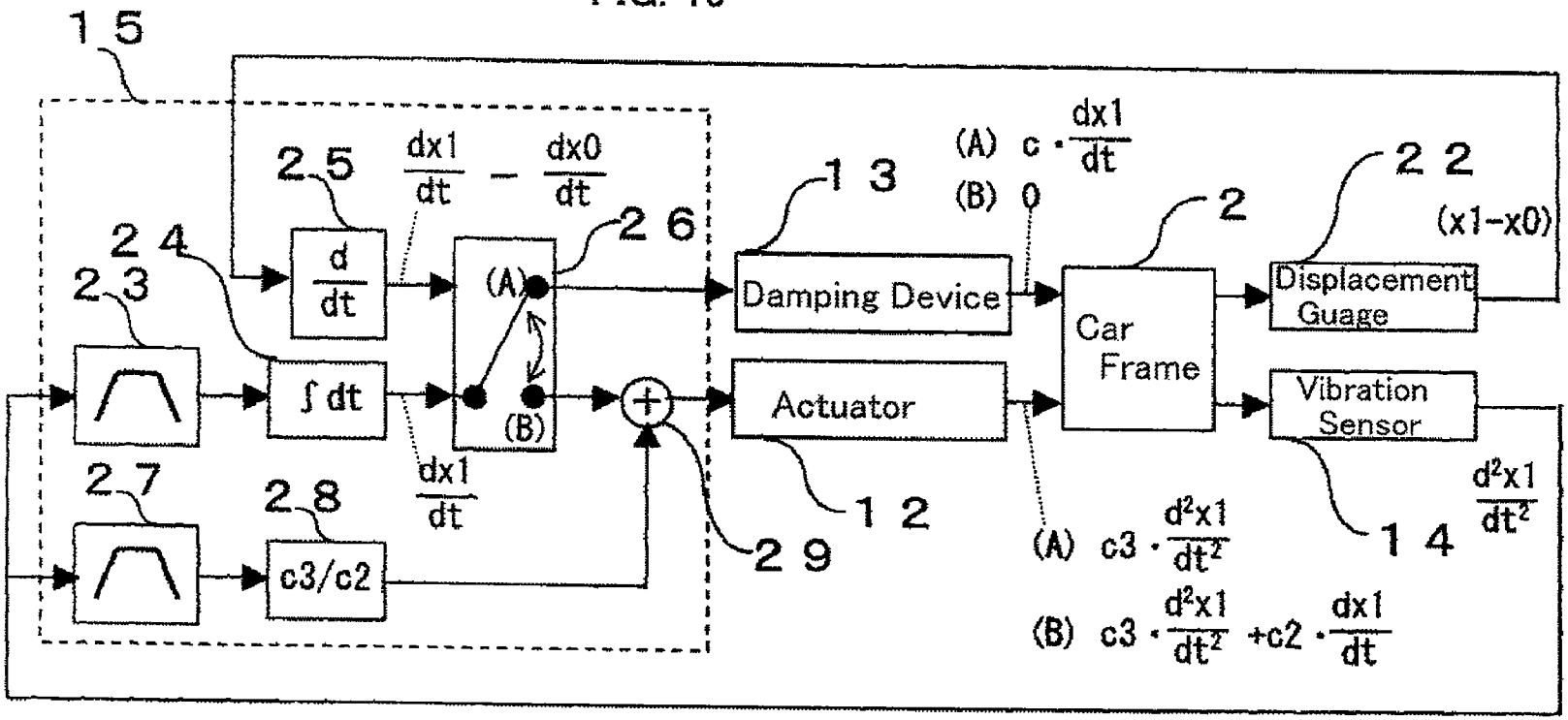
FIG. 19 is a block diagram for explaining a control method according to Embodiment 6 of the present invention.

A control method utilized in Embodiment 6 is to solve the foregoing problem; FIG. 19 is a block diagram for the control method. The control method is the same as the conventional method in FIG. 17, except for the following points.

(1) In the case of (B) in which the pivot damping device 13 cannot generate vibration-damping force, the actuator 12 is made to generate vibration-damping force.

(2) A band-pass filter 27 for eliminating noise and low-frequency components, which is not necessary for the control, from an acceleration signal for the car frame 2, measured by the vibration sensor 14; a multiplier 28 for multiplying the signal, which has passed through the band-pass filter 27, by a predetermined number; and an adder 29 for adding the output signal from the (B) terminal of the switch 26 and the output signal of the multiplier 28 are added so that the actuator 12 always generates vibration-damping force in proportion to the acceleration signal that has passed through the band-pass filter 27.

In addition, instead of adding the band-pass filter 27, the output of the band-pass filter 23 may be inputted to the multiplier 28. The addition of the band-pass filter 27 demonstrates an effect in which different frequency bandwidths can be utilized depending on whether the acceleration is directly utilized or converted into the speed to be utilized.

In the case of the block diagram in FIG. 19, the sum of the vibration-damping force generated by the pivot damping device 13 and the vibration-damping force generated by the actuator 12 is represented in the following equations. Here, a variable $f_c$ denotes the vibration-damping force generated by the actuator 12. Additionally, proportionality coefficients c2 and c3 of appropriate values are utilized in the actuator 12. The multiplier 28 performs multiplication by a predetermined value so that the ratio c3/c2 becomes an appropriate value.

(A) In the case where (dx1/dt−dx0/dt)*(dx1/dt)>0, $$f_d+f_c=c*(dx1/dt)+c3*(d^2x1/dt^2) \quad (6)$$

$$cg=c*((dx1/dt)/(dx1/dt-dx0/dt)) \quad (7)$$

(B) In the case where (dx1/dt−dx0/dt)*(dx1/dt)≦0, $$f_d+f_c=c2*(dx1/dt)+c3*(d^2x1/dt^2) \quad (8)$$

$$cg=0 \quad (9)$$

Even when the vibration-damping force generated by the pivot damping device 13 instantaneously and considerably changes, the actuator 12 generates vibration-damping force in such a way as to abate the change; therefore, the range of the change in the vibration-damping force is diminished. In addition, because the actuator 12 generates vibration-damping force proportional to the acceleration signal, the change in the acceleration can be suppressed. Additionally, even in the case where the generation of vibration-damping force by the actuator 12 when the pivot damping device 13 cannot generate vibration-damping force, or the generation of vibration-damping force, by the actuator 12, which is proportional to the acceleration signal is solely performed, either can demonstrate the same effect.

In Embodiment 1, when a large wind-pressure change is exerted on the cab 1 and the car frame 2, the respective damping coefficients of the direct-acting damper 5 and the pivot damping device 13 are increased. When the respective damping coefficients of the direct-acting damper 5 and the pivot damping device 13 are increased, the cab 1 and the car frame 2 have difficulty in moving with respect to the guide rail 6; this fact suggests that a disturbance from the guide rail 6 is transferred directly to the cab 1. The objective of Embodiment 6 is to prevent a disturbance from the guide rail 6 from being transferred directly to the cab 1 so that a comfortable ride is realized, even in the case where a large wind-pressure change occurs.

In general, in the case of a disturbance caused by a wind-pressure change, a large forcible excitation force is firstly exerted in one direction. In the initial state in which the large excitation force is exerted, the respective directions of the displacement changing speed (dx1/dt−dx0/dt) and the horizontal-directional absolute speed (dx1/dt) are the same; therefore, it is anticipated that the product of those speeds is positive. Accordingly, in the initial state in which large vibration-damping force is required, the pivot damping device 13 generates damping force. Because the damping force is in proportion to the horizontal-directional absolute speed of the car frame 2, the effect of the damping force to suppress the vibration of the car frame 2 is larger than that in the case where, in Embodiment 1, the damping coefficient is kept to be maximal.

It is anticipated that, after the damping force has been applied, the vibration is not as large as it initially was; thus, the pivot damping device 13 and the actuator 12 are concurrently utilized so as to reduce the vibration. Even in this case, the skyhook damping control is performed, and measures are taken for preventing a large change in the vibration-damping force from occurring when the pivot damping device 13 and the actuator 12 are switched over; the effect of suppressing the vibration of the car frame 2 is larger than that in the case where, in Embodiment 1, the damping coefficient is kept to be maximal. In this regard, however, because the actuator 12 is operated, the power consumption is larger than that in the case of Embodiment 1.

As described above, Embodiment 6 demonstrates an effect in which not only a vibration, of the car frame 2, which is caused by a large wind-pressure change due to the mutual passing of the reference car and the adjacent car 16, or the like, can be suppressed, but also a vibration through the guide rail 6 can be suppressed.

Not limiting to the case where a large wind-pressure change occurs, by controlling the sum of the vibration-damping forces generated by the actuator 12 and the pivot damping device 13 in such a way that the sum of the vibration-damping forces is in proportion to the absolute speed of the cab 1 and has a direction in which the sum of the vibration-damping forces serves to suppress the cab 1 from moving, it is made possible to reduce a transverse vibration in the same manner as the actuator 12 does, with power consumption less than that in the case where only the actuator 12 is employed.

The invention claimed is:

1. A vibration damping system for an elevator, comprising:

a damping device that is provided between a cab and a car frame for supporting the cab and whose damping coefficient can be changed;

a vibration sensor provided on the car frame;

an actuator mounted on the car frame for controlling force that presses against a guide rail;

a guide roller that rotatably moves along the guide rail provided in a hoistway;

a speed detection means for detecting the traveling speed of a reference elevator car; and a calculation unit for receiving the traveling speed detected by the speed detection means and a vibration detected by the vibration sensor, calculating control signals for the damping device and the actuator, and outputting the control signals to the damping device and the actuator, the calculation unit controlling the actuator so as to suppress a vibration detected by the vibration sensor, the calculation unit controlling the damping device in such a way that, in the case where the traveling speed exceeds a predetermined value, the damping coefficient of the damping device is rendered larger than that in the case where the traveling speed is the same as or smaller than the predetermined value, the predetermined value being larger than the traveling speed corresponding to the frequency of a first-mode inherent vibration in which an antinode of the vibration falls within the space between the car frame and the guide rail, and the predetermined value being smaller than the traveling speed corresponding to the frequency of a second-mode inherent vibration in which an antinode of the vibration falls within the space between the car frame and the cab.

2. A vibration damping system for an elevator, comprising:

an actuator mounted on the car frame for controlling force that presses against a guide rail a guide roller that rotatably moves along the guide rail provided in a hoistway;

a second damping device, which is mounted on the car frame and whose damping coefficient can be changed, for damping a vibration in which the guide roller transversely moves;

a vibration sensor provided on the car frame;

a displacement detection means for detecting displacement which is the distance between the car frame and the guide rail; and a calculation unit for receiving a signal from the vibration sensor and displacement detected by the displacement detection means, calculating control signals for the second damping device and the actuator, and outputting the control signals to the second damping device and the actuator, the calculation unit controlling the second damping device and the actuator in such a way that, in the case where the product of the speed of a transverse vibration of the car frame obtained from acceleration detected by the vibration sensor and a displacement changing speed obtained from displacement detected by the displacement detection means is positive, the second damping device generates damping force, and in other cases, the actuator generates force for suppressing a vibration of the car frame.

3. A vibration damping system for an elevator, comprising:

an actuator mounted on the car frame for controlling force that presses against a guide rail a guide roller that rotatably moves along the guide rail provided in a hoistway;

a second damping device, which is mounted on the car frame and whose damping coefficient can be changed, for damping a vibration in which the guide roller transversely moves;

a vibration sensor provided on the car frame;

a displacement detection means for detecting displacement which is the distance between the car frame and the guide rail; and a calculation unit for receiving a signal from the vibration sensor and displacement detected by the displacement detection means, calculating control signals for the second damping device and the actuator, and outputting the control signals to the second damping device and the actuator, the calculation unit controlling the second damping device and the actuator in such a way that, in the case where the product of the speed of a transverse vibration of the car frame obtained from acceleration detected by the vibration sensor and a displacement changing speed obtained from displacement detected by the displacement detection means is positive, not only the second damping device generates damping force, but also the actuator generates force that is in proportion to the acceleration detected by the vibration sensor.

4. The vibration damping system for an elevator, according to claim 1, wherein the damping device utilizes an MR fluid.

5. The vibration damping system for an elevator, according to claim 2, wherein the second damping device utilizes an MR fluid.

6. The vibration damping system for an elevator, according to claim 3, wherein the second damping device utilizes an MR fluid.

* * * * *